US009216598B2

(12) United States Patent
Aoki et al.

(10) Patent No.: US 9,216,598 B2
(45) Date of Patent: Dec. 22, 2015

(54) FEEDING APPARATUS AND IMAGE RECORDING APPARATUS

(71) Applicants: Hirotaka Aoki, Nagoya (JP); Tetsuo Asada, Kuwana (JP); Shinichi Hisada, Tokoname (JP); Ryuji Yamamoto, Handa (JP)

(72) Inventors: Hirotaka Aoki, Nagoya (JP); Tetsuo Asada, Kuwana (JP); Shinichi Hisada, Tokoname (JP); Ryuji Yamamoto, Handa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/851,754

(22) Filed: Mar. 27, 2013

(65) Prior Publication Data

US 2014/0002561 A1 Jan. 2, 2014

(30) Foreign Application Priority Data

Jun. 29, 2012 (JP) ..... 2012-146601

(51) Int. Cl.

*B41J 13/10* (2006.01)
*B65H 1/04* (2006.01)
*B65H 1/26* (2006.01)

(52) U.S. Cl.

CPC ..... *B41J 13/103* (2013.01); *B65H 1/04* (2013.01); *B65H 1/266* (2013.01); *B65H 2405/113* (2013.01); *B65H 2405/332* (2013.01)

(58) Field of Classification Search

CPC ..... B65H 3/44; B65H 3/46; B65H 1/04; B65H 1/266; B41J 13/10; B41J 13/103
USPC ..... 271/9.01, 9.02, 9.04, 9.05, 9.06, 9.07, 271/9.08; 347/101, 104
See application file for complete search history.

(56) References Cited

U.S. PATENT DOCUMENTS

2007/0075477 A1* 4/2007 Shiohara ..... 271/9.08
2007/0120314 A1* 5/2007 Koga ..... 271/10.11
2009/0236791 A1* 9/2009 Chino ..... 271/9.01

FOREIGN PATENT DOCUMENTS

JP 2009-227377 A 10/2009
JP 2010-242928 A 10/2010
JP 2012-030957 A 2/2012
JP 2012-035931 A 2/2012
JP 2012-035949 A 2/2012
JP 2012035949 A * 2/2012

OTHER PUBLICATIONS

Nakamura, Kazuhisa, MachineTranslationof—JP2012-035949A, Feb. 2012.*

* cited by examiner

*Primary Examiner* — Geoffrey Mruk
*Assistant Examiner* — Scott A Richmond
(74) *Attorney, Agent, or Firm* — Merchant & Gould PC

(57) ABSTRACT

A feeding apparatus includes an apparatus main body; a feeding section which feeds sheets in a feeding orientation; a feed tray which has a first tray to load some of the sheets, and a second tray provided above the first tray to load the rest of the sheets, and which is movable relative to the apparatus main body along the feeding orientation; and a guide which guides the sheets by contact with the sheets fed by the feeding section. At an end portion of the first tray on the downstream side in the feeding orientation, a first projective portion is formed to project upward and have a supporting portion capable of supporting the second tray on its upper end, and a second projective portion is formed to project upward from a different position from the first projective portion in a width direction perpendicular to the feeding orientation.

25 Claims, 12 Drawing Sheets

FEEDING APPARATUS AND IMAGE RECORDING APPARATUS

CROSS REFERENCE TO RELATED APPLICATION

The present application claims priority from Japanese Patent Application No. 2012-146601, filed on Jun. 29, 2012, the disclosure of which is incorporated herein by reference in its entirety.

BACKGROUND OF THE INVENTION

1. Field of the Invention

The present invention relates to a feeding apparatus capable of feeding sheets of recording medium, and an image recording apparatus including the feeding apparatus.

2. Description of the Related Art

Conventionally, there has been known a feeding apparatus which includes trays capable of loading sheets of recording medium and which feeds the sheets from the trays to an image recording apparatus such as ink-jet type, electrophotographic type or the like in a state that the trays are installed in the image recording apparatus. It has been known that the above image recording apparatus has a plurality of trays installed in a superimposed manner. The plurality of trays load different sizes of sheets and/or different types of sheets (plain paper and glossy paper for example).

Further, the plurality of trays are not limited to a structure in which each tray is provided as an individual member. For example, the image recording apparatus may have a structure in which one cassette which includes a plurality of layered trays is installable. Japanese Patent Application Laid-Open No. 2009-227377 discloses an image recording apparatus including such a cassette. The cassette disclosed in Japanese Patent Application Laid-Open No. 2009-227377 has an upper tray supported by a lower tray, and the upper tray is movable relative to the lower tray. When the upper tray is moved up to a tip-end portion of the cassette, the upper tray is supported by a frictional separator which is an inclined plate provided at the tip-end portion of the cassette. By virtue of this, the upper tray is stabilized in terms of vertical or up-down position.

Further, Japanese Patent Application Laid-Open No. 2010-242928 discloses an image recording apparatus in which the abovementioned inclined plate is provided in the image recording apparatus rather than in the cassette or trays. The abovementioned inclined plate has a function of preventing the sheets loaded in the cassette or tray from falling out of the cassette or tray when removing the cassette or tray from the image recording apparatus. Therefore, in the cassette without any inclined plate as disclosed in Japanese Patent Application Laid-Open No. 2010-242928, instead of the inclined plate, a stopper is provided at the tip-end portion of the cassette or tray to fulfill the above function.

In the cassette disclosed in Japanese Patent Application Laid-Open No. 2009-227377 in which the upper tray is movable relative to the lower tray, such a configuration as follows is preferable if the inclined plate is removed from the tip-end portion of the cassette and, instead, stoppers are arranged at the tip-end portion. That is, the stoppers are arranged in the upper tray and the lower tray respectively, and the stopper arranged in the lower tray is configured to support and stabilize the upper tray in terms of the up-down position of the upper tray.

However, such configuration as described above may give rise to the following problem. That is, if the upper tray moves relative to the lower tray toward the tip-end portion, i.e. toward the stopper in a state that the sheets are loaded in the lower tray, the uppermost one of the sheets loaded in the lower tray is liable to move to follow the lower surface of the upper tray.

Although the stopper arranged in the lower tray supports the upper tray, if the upper tray is bending, an interspace arises between the upper end of the stopper and the lower surface of the upper tray. In such case, the sheet, which is moving to follow the lower surface of the moving upper tray, is liable to enter the interspace. As a result, the sheet is liable to be sandwiched between the stopper and the upper tray, and hence to be bent and broken.

SUMMARY OF THE INVENTION

The present teaching is made in view of the above problem, and an object thereof is to provide a feeding apparatus capable of reducing the possibility that the sheets loaded in the lower tray may move to follow the movement of the upper tray, and an image recording apparatus including the feeding apparatus.

According to a first aspect of the present teaching, there is provided a feeding apparatus configured to feed sheets, the apparatus including: an apparatus main body; a feeding section configured to feed the sheets in a feeding orientation; a feed tray, which has a first tray having a first loading plate for loading some of the sheets, and a second tray provided above the first tray and having a second loading plate for loading the other of the sheets, and which is movable relative to the apparatus main body along the feeding orientation between a first position at which the feeding section can feed the sheets and a second position at which the feeding section cannot feed the sheets; and a guide provided in the apparatus main body and having a guide surface for guiding the sheets which are fed by the feeding section from the feed tray at the first position and which make contact with the guide surface, wherein the first tray includes: a first projective portion which projects upward from an end portion of the first loading plate on the downstream side in the feeding orientation and has a supporting portion capable of supporting the second tray on its upper end; and a second projective portion which projects upward from the end portion of the first loading plate on the downstream side in the feeding orientation at a position different from the first projective portion in a width direction perpendicular to the feeding orientation; wherein the first projective portion and the second projective portion are positioned on the downstream side with respect to the guide surface in the feeding orientation in a state that the feed tray is at the first position, and the first projective portion and the second projective portion are positioned on the upstream side with respect to the guide surface in the feeding orientation in a state that the feed tray is at the second position; wherein the second tray has a supported portion configured to be supported by the supporting portion, and is movable relative to the first tray between a third position at which the supported portion overlaps with the supporting portion in the feeding orientation and a fourth position at which the supported portion is on the upstream side with respect to the supporting portion in the feeding orientation; and wherein the second projective portion has a contact portion which is positioned on the upstream side with respect to the supporting portion in the feeding orientation and which is configured to make contact with tip-ends of the sheets at least from a position as high as the supporting portion to a position higher than the supporting portion.

According to the above configuration, the first tray includes the second projective portion in addition to the first projective portion. Here, the second projective portion has the contact portion which is arranged on the upstream side with respect to the supporting portion in the feeding orientation at least from the position as high as the supporting portion to the position higher than the supporting portion. Therefore, even if any of the sheets loaded on the first loading plate moves to follow the movement of the second tray relative to the first tray along the feeding orientation, and attempts to ride on the supporting portion at the upper end of the first projective portion, that sheet still contacts with the contact portion. That is, the contact portion can restrain the sheet from riding on the supporting portion.

According to a second aspect of the present invention, there is provided a feeding apparatus configured to feed sheets, the apparatus including: an apparatus main body; a feeding section configured to feed the sheets in a feeding orientation; a feed tray, which has a first tray having a first loading plate for loading some of the sheets, and a second tray provided above the first tray and having a second loading plate for loading the other of the sheets, and which is changeable in its state relative to the apparatus main body between a first state in which the feeding section can feed the sheets and a second state in which the feeding section cannot feed the sheets; and a guide provided in the apparatus main body and having an inclined surface, the inclined surface being inclined such that its upper end is positioned on the downstream side with respect to its lower end in the feeding orientation and guiding the sheets which are fed by the feeding section from the feed tray in the first state and which make contact with the inclined surface, wherein the first tray includes projective portions projecting upward from an end portion of the first loading plate on the downstream side in the feeding orientation at two different positions in a width direction perpendicular to the feeding orientation, respectively; wherein each of the projective portions has a first projective portion provided with a supporting portion for supporting the second tray at an upper end of the first projective portion, and a second projective portion positioned on the outside of the first projective portion in the width direction to extend above the second loading plate; and in a state that the feed tray is in the first state, the projective portions are positioned on the downstream side with respect to the inclined surface in the feeding orientation, and in a state that the feed tray is in the second state, the projective portions are positioned on the upstream side with respect to the inclined surface in the feeding orientation; wherein the second tray has a third projective portion projecting upward from an end portion of the second loading plate on the downstream side in the feeding orientation and a supported portion configured to be supported by the supporting portion below the third projective portion, and the second tray is changeable in its state relative to the first tray between a third state in which the supported portion is at the same position as the supporting portion in the feeding orientation and a fourth state in which the supported portion is on the upstream side with respect to the supporting portion in the feeding orientation; wherein in a state that the feed tray is in the first state and the second tray is in the third state, the third projective portion is positioned on the downstream side with respect to the inclined surface in the feeding orientation, and in a state that the second tray is in the fourth state, the third projective portion is positioned on the upstream side with respect to the inclined surface in the feeding orientation; wherein each of the second projective portions has a contact portion having a surface which is positioned on the upstream side with respect to the supporting portion in the feeding orientation and intersects with the feeding orientation at least from a position as high as the supporting portion to a position higher than the supporting portion; and wherein an area of the second projective portion different from the contact portion on the upstream side in the feeding orientation, and areas of the first projective portion and the third projective portion on the upstream side in the feeding orientation are each step-like such that its upper end is on the downstream side with respect to its lower end in the feeding orientation.

According to the above configuration, the first tray includes the second projective portion in addition to the first projective portion. Here, the second projective portion is positioned on the upstream side to the supporting portion in the feeding orientation at least from the position as high as the supporting portion to the position higher than the supporting portion. Therefore, even if any of the sheets loaded on the first loading plate moves to follow the movement of the second tray relative to the first tray along the feeding orientation, and attempts to ride on the supporting portion at the upper end of the first projective portion, that sheet still contacts with the second projective portion. That is, the second projective portion can restrain the sheet from riding on the supporting portion.

BRIEF DESCRIPTION OF THE DRAWINGS

FIG. 9C is a view in which FIG. 9B is added to FIG. 9A with broken lines, FIG. 9F is a view in which FIG. 9E is added to FIG. 9D with broken lines, FIG. 9I is a view in which FIG. 9H is added to FIG. 9G with broken lines.

DESCRIPTION OF THE PREFERRED EMBODIMENT

Figure 1:
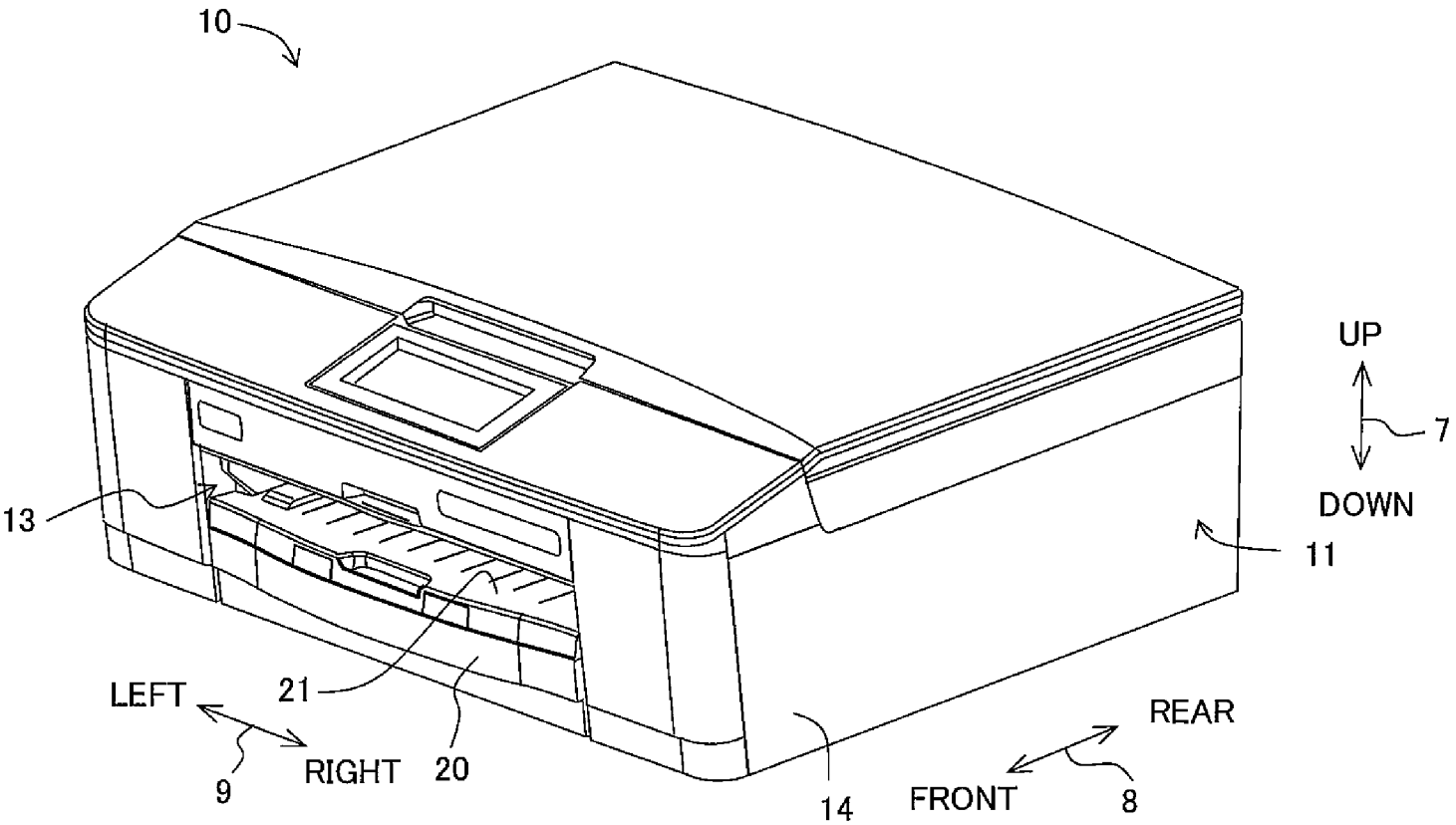
FIG. 1 is a perspective view of a multifunction printer.

An embodiment of the present teaching will be explained below. Further, it is needless to say that the embodiment to be explained below is merely an example of the present teaching, and it is possible to appropriately change the embodiment of the present teaching without departing from the gist and scope of the present teaching. Further, in the following explanation, "orientation" is expressed by the progression of an arrow from start point to end point while "direction" is expressed by the come-and-go on the line linking the start point and the end point of an arrow. Further, in the following explanation, up-down direction 7 is defined on the basis of such a state that a multifunction printer 10 is placed to be usable (a state shown in FIG. 1); front-rear direction 8 is defined as an opening 13 is provided on the near side (the front side); and left-right direction 9 is defined as the multifunction printer 10 is viewed from the near side (the front side).

<Entire Structure of the Multifunction Printer 10>

As shown in FIG. 1, the multifunction printer 10 has an approximately cuboid form, and includes a printer section 11 of ink-jet type (an example of the image recording apparatus of the present teaching). The multifunction printer 10 has various functions such as a facsimile function, a print function, etc.

The printer section 11 has a housing body 14 with the opening 13 formed in its front side (an example of the apparatus main body of the present teaching). Further, a paper feed tray 20 (an example of the feed tray of the present teaching) and a paper discharge tray 21 are insertable to and removable from the housing body 14 via the opening 13 in the front-rear direction 8. The paper feed tray 20 loads sheets of recording paper 12 (an example of the sheets of the present teaching) in desirable sizes such as the size of A4 (297 mm×210 mm), the size of B5 (257 mm×182 mm), and the like.

Figure 2:
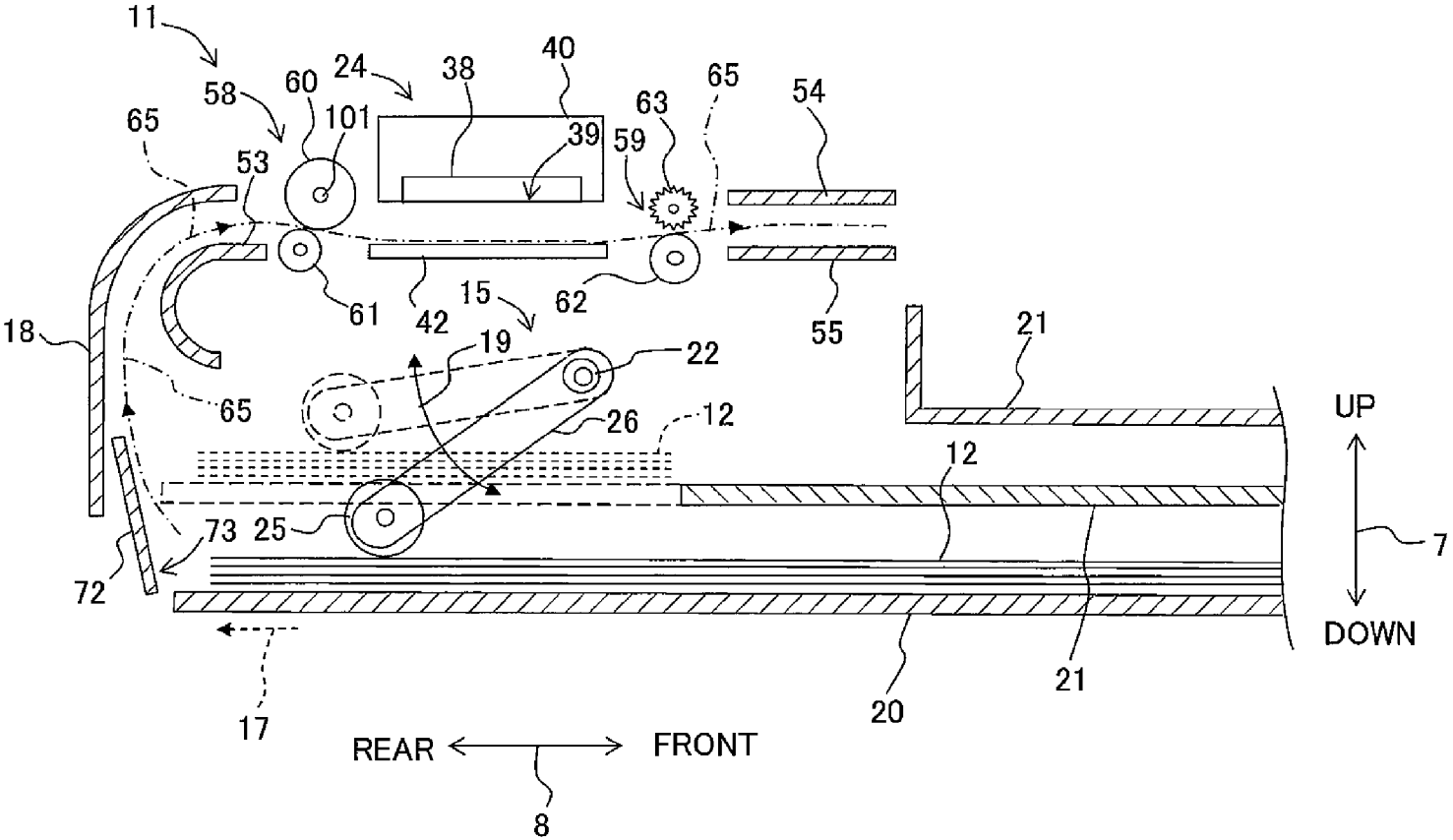
FIG. 2 is a vertical cross-sectional view schematically showing an internal structure of a printer section.

As shown in FIG. 2, the printer section 11 includes: a recording section 24 which records images on the recording paper 12 in an ink-jet manner; a feeding apparatus which has the housing body 14 (see FIG. 1), a paper feed section 15 (an example of the feeding section of the present teaching), the paper feed tray 20, and a guide 72; and the like.

<Paper Feed Tray 20>

As shown in FIG. 2, the paper feed tray 20 is arranged below the aftermentioned recording section 24 in a state of being inserted in the printer section 11. The paper feed tray 20 is inserted backward into the opening 13 of the printer section 11 up to a predetermined position. When the paper feed tray 20 is situated at the predetermined position, the paper feed tray 20 engages with an unshown engagement portion formed on the housing body 14. The paper feed tray 20 is thus installed in the printer section 11 at this predetermined position. Further, by withdrawing or retreating the paper feed tray 20 frontward from the state of being installed in the printer section 11 to disengage the paper feed tray 20 from the engagement portion of the housing body 14, the paper feed tray 20 is moved from the predetermined position, and then removed from the opening 13. That is, the paper feed tray 20 is movable relative to the housing body 14 along the front-rear direction 8, in other words, along an aftermentioned feeding orientation 17.

When the paper feed tray 20 is installed in the printer section 11, the aftermentioned paper feed section 15 can feed the recording paper 12 loaded in the paper feed tray 20 to a transport path 65. The recording section 24 records images on the recording paper 12 fed from the paper feed tray 20 to the transport path 65, and then the recording paper 12 is discharged to the upper surface of the paper discharge tray 21. On the other hand, when the paper feed tray 20 is removed from the printer section 11, the paper feed section 15 cannot feed the recording paper 12 loaded in the paper feed tray 20 to the transport path 65. That is, in this embodiment, the predetermined position of the paper feed tray 20 when the paper feed tray 20 is installed in the printer section 11 is an example of the first position and the first state of the present teaching, while a position of the paper feed tray 20 when the paper feed tray 20 is drawn out from the predetermined position is an example of the second position and the second state of the present teaching. The second position and the second state are not limited only to the position and the state where the paper feed tray 20 is completely drawn out of the printer section 11, but include any position or state where the paper feed tray 20 is drawn out from the first position to the front side and the paper feed section 15 cannot feed the recording paper 12.

Figure 4:
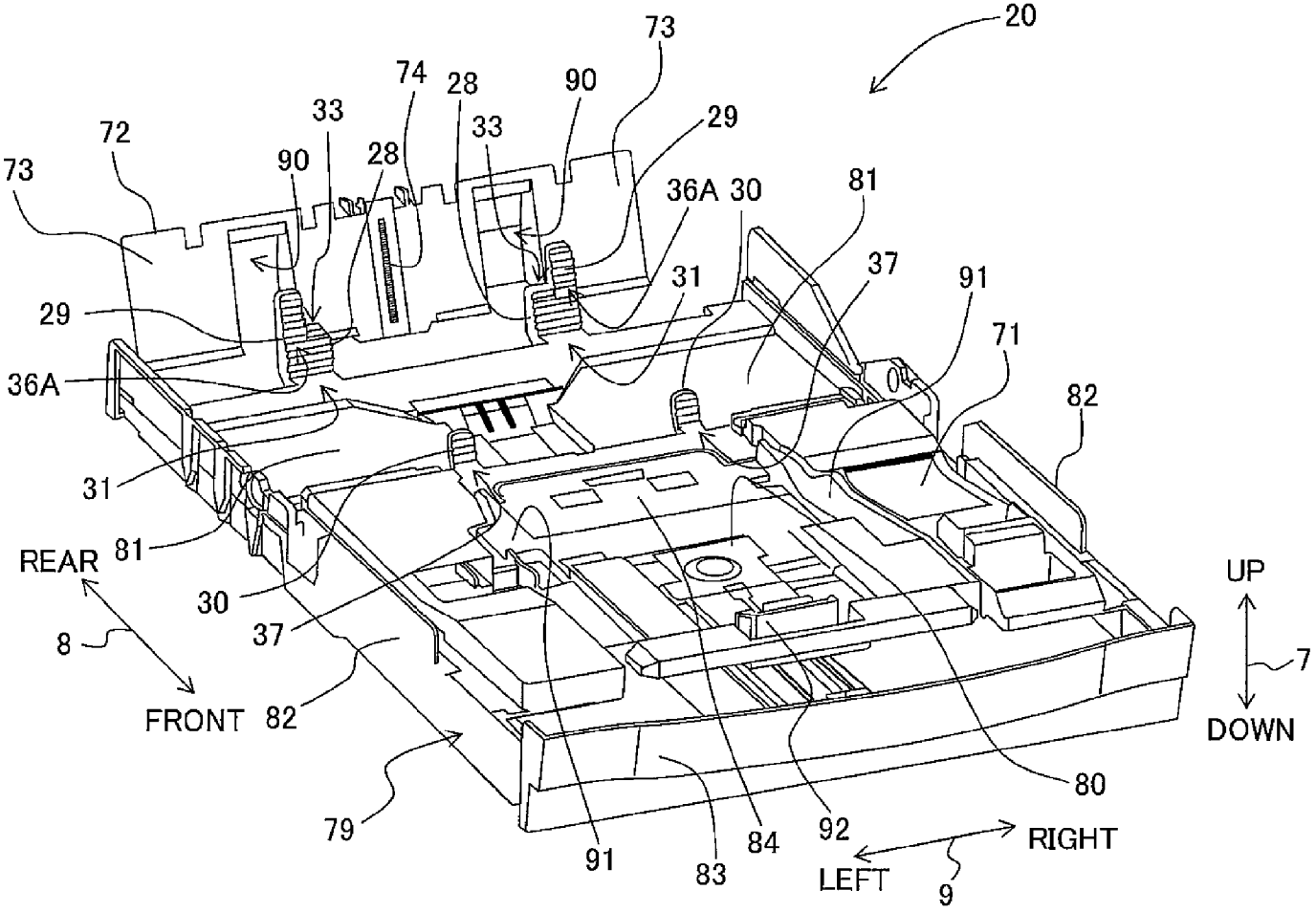
FIG. 4 is a perspective view of the paper feed tray at a second position and a guide, in which a second tray at a fourth position is shown.
Figure 5:
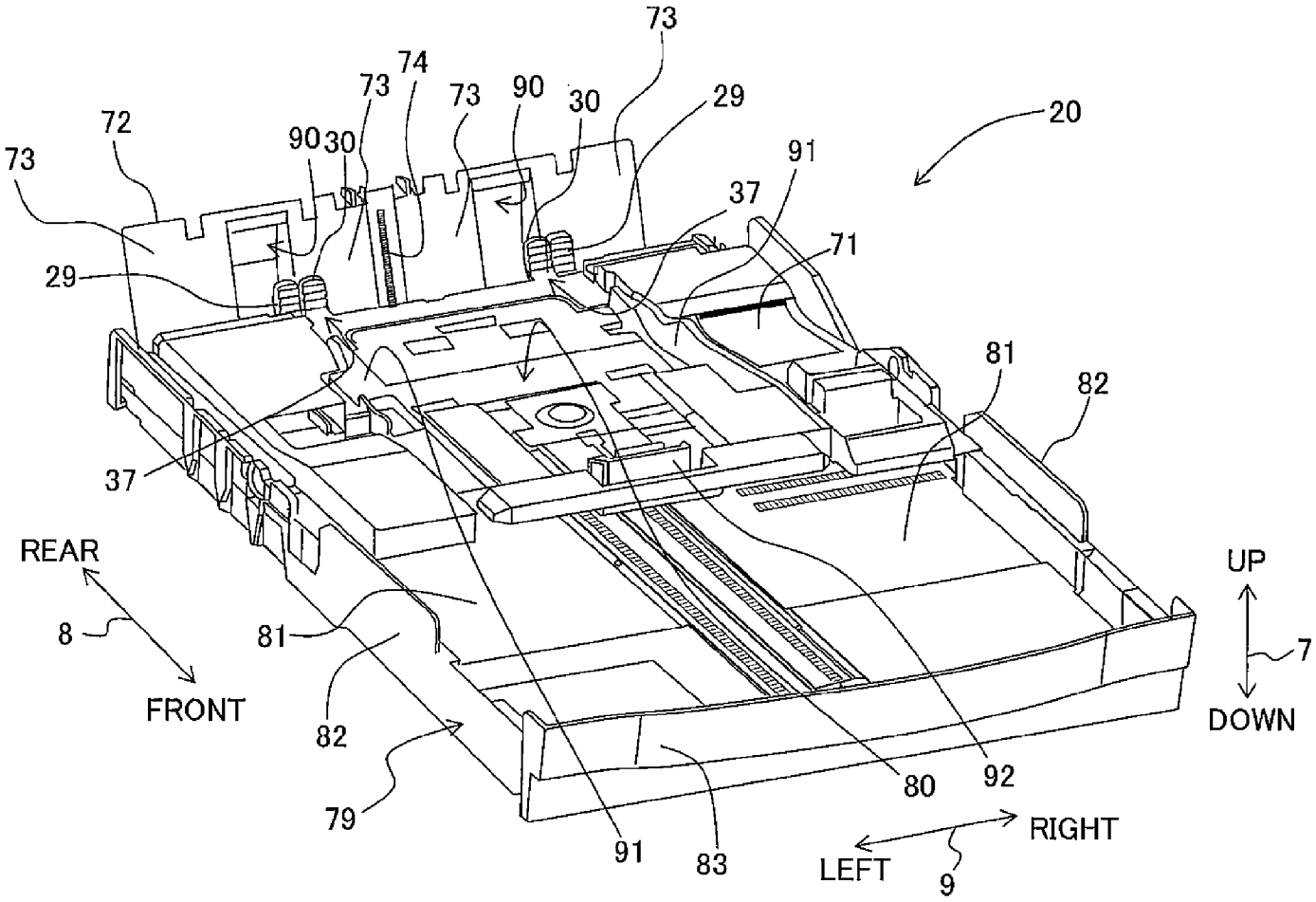
FIG. 5 is a perspective view of the paper feed tray at the second position and the guide, in which the second tray at a third position is shown.

As shown in FIGS. 4 and 5, the paper feed tray 20 includes a first tray 79 formed to be approximately box-like with an open top, and a second tray 80 supported by the first tray 79 on the upper side of the first tray 79.

The paper feed tray 20 includes a first loading plate 81 on which the recording paper 12 is loaded, a pair of side plates 82 which stand upward and extend in the front-rear direction 8 respectively at both left and right ends of the first loading plate 81, and a frontal plate 83 which stands upward and extends in the left-right direction 9 at the front end of the first loading plate 81. The first loading plate 81 is plate-like with a flat surface along the front-rear direction 8 and the left-right direction 9. On the first loading plate 81, there are fitted a pair of side guides (not shown) slidable in the left-right direction 9, and a rear guide (not shown) slidable in the front-rear direction 8. The side guides contact respectively with both left and right edges of the recording paper 12 loaded on the first loading plate 81, while the rear guide contacts with the front edge of the recording paper 12 loaded on the first loading plate 81. When one of the side guides is slid, the other of the side guides moves together to slide in the opposite direction of the movement of the one of the side guides. With the side guides and rear guide as above, the first loading plate 81 can load the recording paper 12 in various sizes with reference to the middle of the first loading plate 81 in the left-right direction 9.

Figure 3:
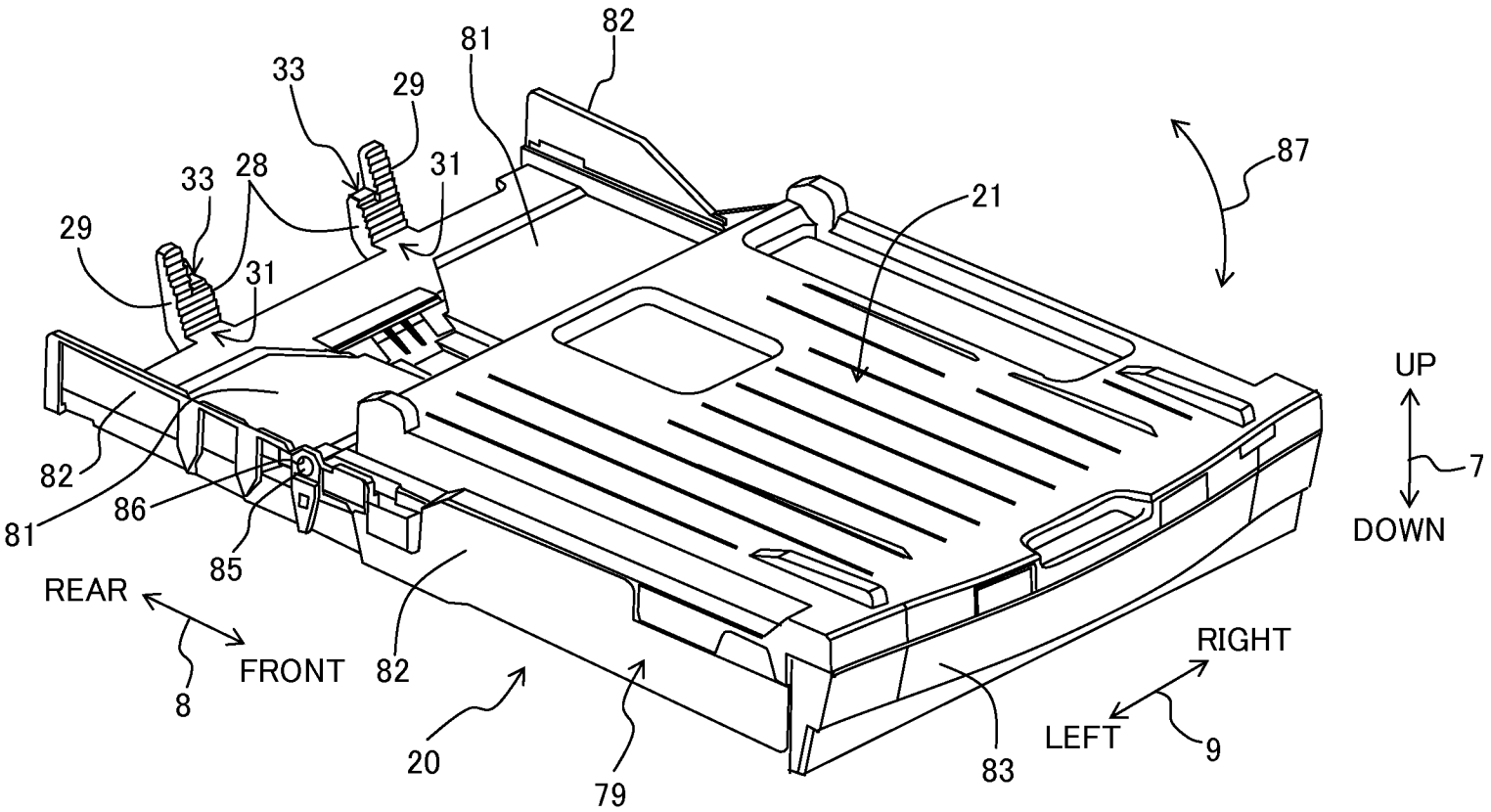
FIG. 3 is a perspective view of a paper feed tray and a paper discharge tray.

As shown in FIG. 3, the paper discharge tray 21 is arranged on the open top of the paper feed tray 20. The paper discharge tray 21 is supported by the frontal plate 83 of the paper feed tray 20. Further, as will be described in detail, the paper discharge tray 21 is also supported by the side plates 82 via a shaft 85. That is, on the rear end and at both left and right ends of the paper discharge tray 21, the shaft 85 is formed to extend outward along the left-right direction 9, and inserted into shaft holes 86 formed in the side plates 82. By virtue of this, the paper discharge tray 21 revolves along a direction shown by an arrow 87. The revolution of the paper discharge tray 21 opens or closes the top of the paper feed tray 20.

As shown in FIGS. 4 and 5, the second tray 80 includes a second loading plate 84 on which sheets of recording papers are loaded. Similar to the first loading plate 81, the second loading plate 84 is also plate-like with a flat surface along the front-rear direction 8 and the left-right direction 9. In this embodiment, the recording paper loaded on the second loading plate 84 is smaller in size than the recording paper 12 loaded on the first loading plate 81. In particular, similar to the first loading plate 81, the second loading plate 84 is also provided with side guides 91 and a rear guide 92, but the movement range of the side guides 91 is confined to the center of the left-right direction 9 more than the movement range of the side guides provided for the first loading plate 81. Further, the length of the second loading plate 84 in the front-rear direction 8 is shorter than the length of the first loading plate 81 in the front-rear direction 8.

Figure 6:
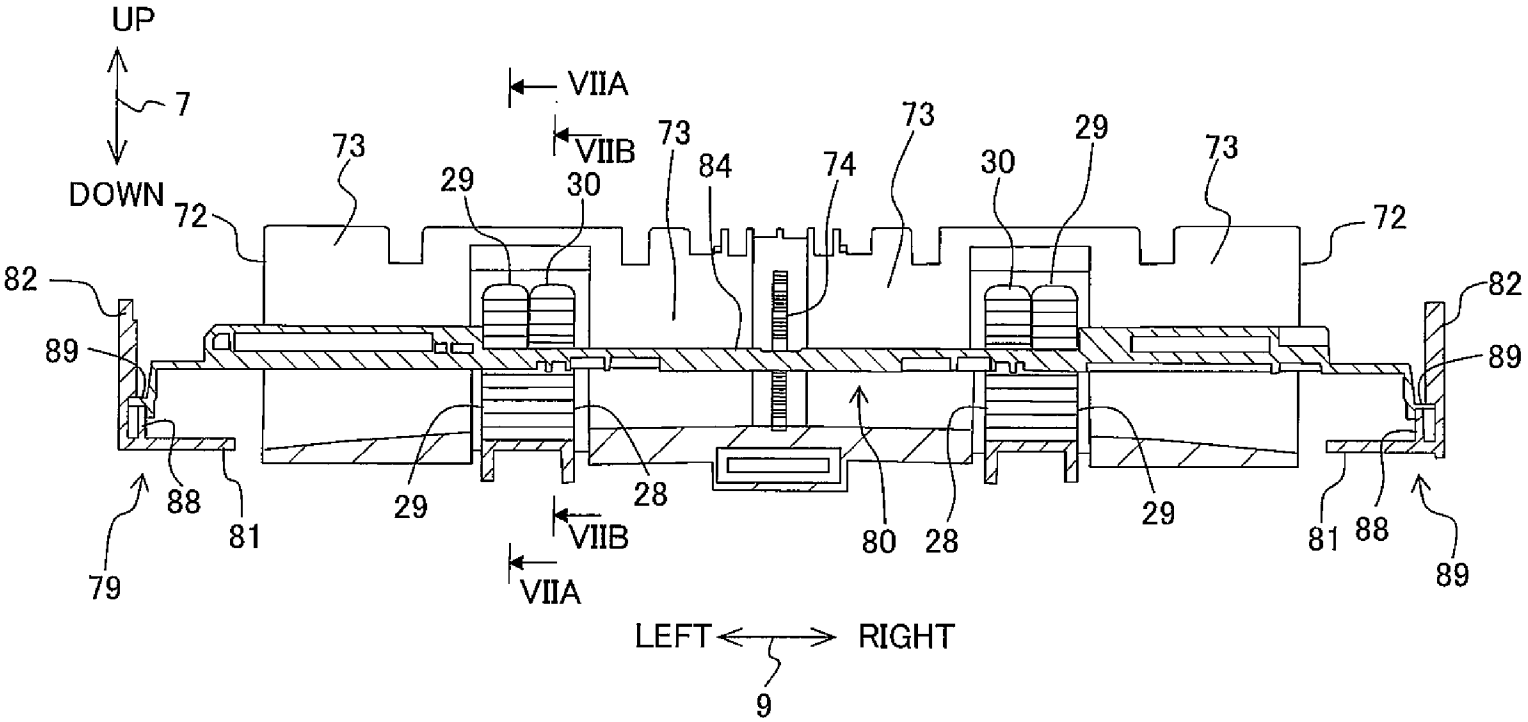
FIG. 6 is a front view of the guide, in which the second tray at the third position is shown.

As shown in FIG. 6, at each part of the left and right ends of the first loading plate 81 of the first tray 79, a protruding portion 88 is formed to stand upward and extend in the front-rear direction 8 (an example of the movement support portions of the present teaching). Further, the lower portions of the pair of side plates 82 of the first tray 79 are formed more slimly than the upper portions. Further, at each part of the left and right ends of the second loading plate 84 of the second tray 80, a supported plate 89 is formed to extend outward in the left-right direction 9.

The supported plates 89 of the second tray 80 are supported by the protruding portions 88 while contacting with the slimly formed lower portions of the pair of side plates 82. By virtue of this, the supported plates 89 of the second tray 80 become sandwiched by the protruding portions 88 of the first tray 79 and the pair of side plates 82, respectively. As a result, the second loading plate 84 of the second tray 80 can move relative to the first tray 79 along the front-rear direction 8 while being supported by the protruding portions 88. In particular, the second tray 80 can move relative to the first tray 79 between a third position shown in FIG. 5 (an example of the third state of the present teaching) and a fourth position shown in FIG. 4 (an example of the fourth state of the present teaching). In the above manner, the first tray 79 includes the protruding portions 88 at both ends in the left-right direction 9 which supports the second tray 80 to be movable relative to the first tray 79.

<Paper Feed Section 15>

Figure 10:
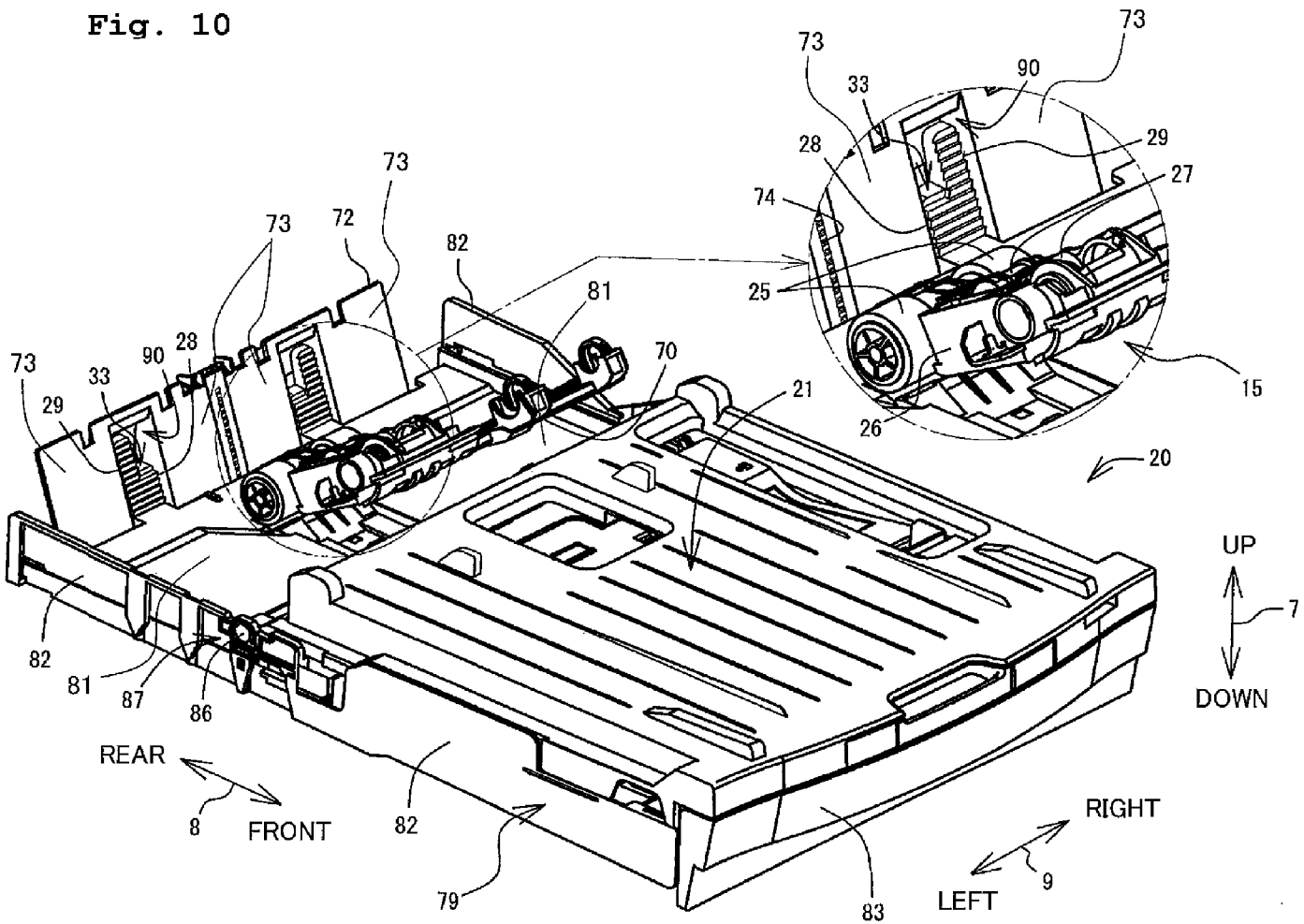
FIG. 10 is a perspective view of the paper feed tray, a paper discharge tray, a paper feed section and the guide, in which the paper feed tray at a first position and the second tray at the fourth position are shown.
Figure 11:
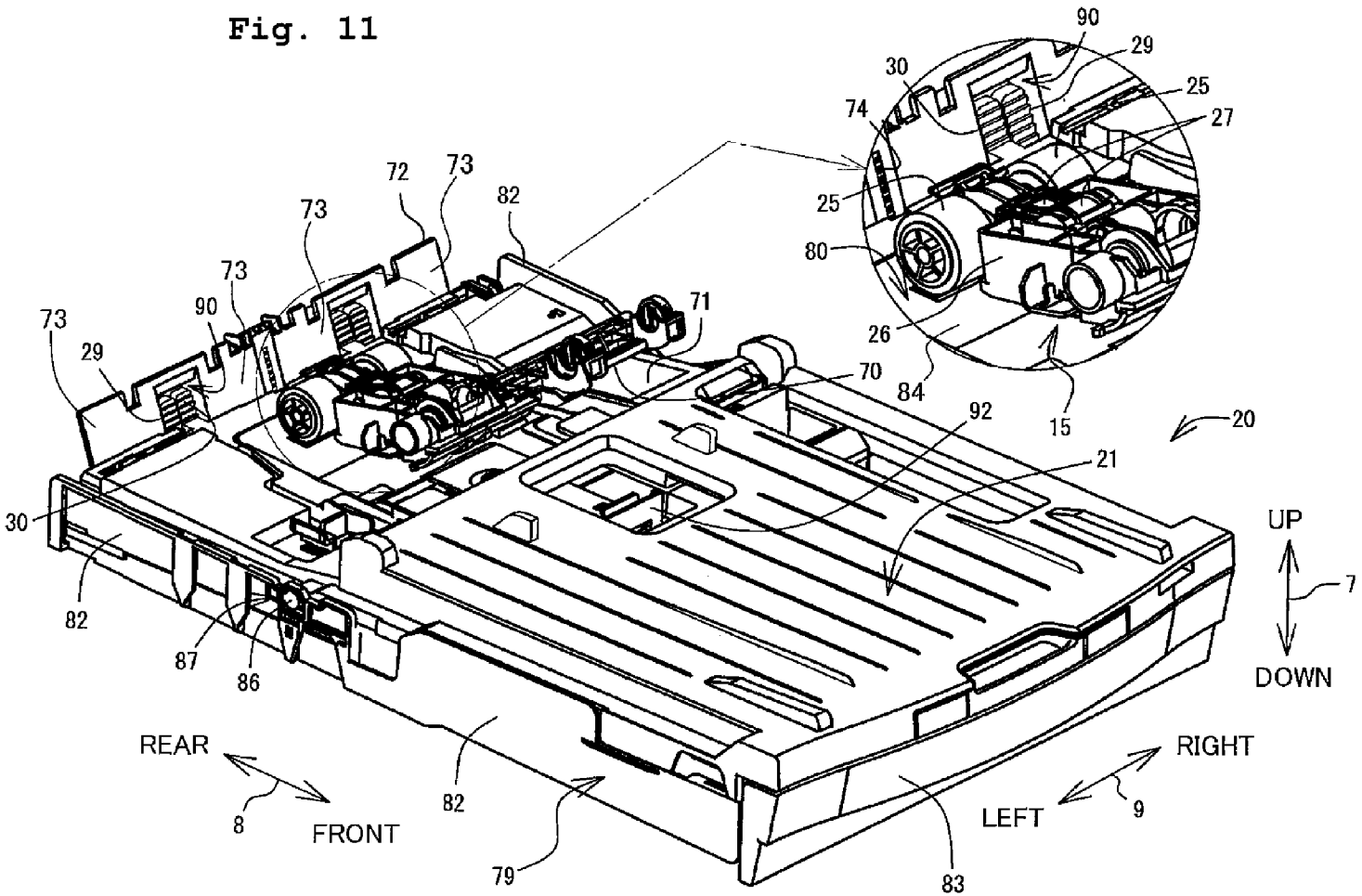
FIG. 11 is a perspective view of the paper feed tray, the paper discharge tray, the paper feed section and the guide, in which the paper feed tray at the first position and the second tray at the third position are shown.

As shown in FIGS. 2, 10 and 11, the paper feed section 15 is provided above the paper feed tray 20. The paper feed section 15 includes a paper feed roller 25 (an example of the feed roller of the present teaching), a paper feed arm 26 (an example of the arm of the present teaching), a drive force transmission mechanism 27, and a shaft 22 (an example of the supporting shaft of the present teaching). The paper feed arm 26 is retained by the shaft 22 to be revolvable about one end. By virtue of this, the paper feed arm 26 revolves about the shaft 22 in a direction shown by an arrow 19 in FIG. 2. The paper feed roller 25 is supported to be rotatable at the other end of the paper feed arm 26. Via the drive force transmission mechanism 27, a drive force is transmitted from a paper feed motor (not shown) to the paper feed roller 25 to rotate the paper feed roller 25. Here, the drive force transmission mechanism 27 has a structure in which, for example, a plurality of gears are engaged. The paper feed arm 26 includes a plate-like cam follower portion 70 extending rightward from the middle of the paper feed tray 20 in the left-right direction 9 (see FIGS. 10 and 11). The cam follower portion 70 is formed at a position contactable with a cam portion 71 provided in the second tray 80 (see FIG. 4). As shown in FIG. 4, the cam portion 71 has different heights along the front-rear direction 8. As shown in FIGS. 10 and 11, according to the movement of the second tray 80 or the paper feed tray 20 in the front-rear direction 8, the cam portion 71 contacts with the cam follower portion 70 to let the paper feed roller 25 contact with or depart from the first loading plate 81 of the first tray 79 and the second loading plate 84 of the second tray 80.

In a state that any external force is not applied to the paper feed arm 26, the paper feed arm 26 is biased by its own weight, an unshown spring, or the like, to revolve downward. If the paper feed tray 20 is at the first position and the second tray 80 is at the fourth position, the paper feed roller 25 is in contact with the uppermost sheet of the recording paper 12 loaded on the first loading plate 81 of the first tray 79 as shown in FIG. 10 and shown by the solid line in FIG. 2. Further, if the second tray 80 is moved from the fourth position to the third position when the paper feed tray 20 is at the first position, as shown in FIG. 11, the cam follower portion 70 of the paper feed arm 26 contacts with the cam portion 71 of the second tray 80. Because the cam portion 71 presses the cam follower portion 70, the paper feed roller 25 revolves upward. Then, if the second tray 80 is further pushed on to the third position, then the cam follower portion 70 comes downward following the cam portion 71 which is inclined such that the more rearward the more downward, and thereby the paper feed roller 25 revolves downward. By virtue of this, if the paper feed tray 20 is at the first position and the second tray 80 is at the third position, then the paper feed roller 25 is in contact with the uppermost sheet of the recording paper 12 loaded on the second loading plate 84 of the second tray 80 as shown in FIG. 11 and shown by the broken line in FIG. 2. Further, if the paper feed tray 20 is pushed on from the second position to the first position when the second tray 80 is at the third position, the cam follower portion 70 is pressed upward by the cam portion 71 of the second tray 80, and the paper feed roller 25 first revolves upward and then revolves downward to contact with the uppermost sheet of the recording paper 12 loaded on the second loading plate 84 of the second tray 80. In this embodiment, when the paper feed tray 20 is drawn out to the second position from the first position, i.e. from the paper feed position, it is possible for a user to move the second tray 80. However, as a matter of course, it is also possible to provide a movement mechanism to the apparatus main body which moves the second tray 80 in the state that the paper feed tray 20 is installed at the first position.

As shown in FIG. 2, the paper feed roller 25 transports the contacted sheet of the recording paper 12 in the feeding orientation 17. Here, the feeding orientation 17 is a rearward orientation shown in FIG. 2 by the arrow of broken line. In the above manner, the paper feed section 15 feeds the sheet of the recording paper 12 loaded in the paper feed tray 20 (the first tray 79 or the second tray 80) in the feeding orientation 17.

<Guide 72>

As shown in FIGS. 2, 4 and 5, the guide 72 is provided in the housing body 14 of the printer section 11. The guide 72 stands upward from a rear and lower end portion of the housing body 14.

On the front side of the guide 72, an inclined surface 73 is formed to extend obliquely upward and rearward from the lower end of the guide 72 (an example of the guide surface of the present teaching). In this embodiment, the inclined surface 73 is inclined such that its upper end may be positioned on the downstream side from its lower end in the feeding orientation 17. Further, while an arbitrary angle may adapt to the inclination angle formed between the inclined surface 73 and the first loading plate 81 or the second loading plate 84, it is preferably the same as the inclination angles of aftermentioned surfaces 32 which are front surfaces of a first projective portion 28, surfaces 36 which are front surfaces of a second projective portion 29, and surfaces 35 which are front surfaces of a third projective portion 30 (see FIGS. 7A and 7B). Of course, the inclination angle of the inclined surface 73 may also be 90 degrees.

The inclined surface 73 plays the role of guiding the recording paper 12, which is loaded in the paper feed tray 20 at the first position and is fed by the paper feed section 15 in the feeding orientation 17, to a transport path 65 (see FIG. 2). A plurality of separation teeth 74 are arranged in the middle of the inclined surface 73 to project from the inclined surface 73 and to align in the up-down direction 7. By letting the separation teeth 74 contact with a plurality of sheets of the recording paper 12 fed by the paper feed roller 25, each sheet of the recording paper 12 is separated. Then, only the uppermost sheet of the recording paper 12 is guided by the inclined surface 73 to the upper transport path 65. At this time, the inclined surface 73 contacts with the tip-end portion and lower surface of the recording paper 12 to guide the recording paper 12.

In the inclined surface 73 of the guide 72, recesses 90 are formed to dent rearward, i.e. toward the downstream side in the feeding orientation 17. In this embodiment, the recesses 90 are formed in two places apart from each other in the left-right direction 9. In particular, the recesses 90 are formed at the positions corresponding to the aftermentioned first projective portions 28, second projective portions 29 and third projective portions 30 in the left-right direction 9. By virtue of this, as will be described hereinafter, it is possible to insert the first projective portions 28, the second projective portions 29 and the third projective portions 30 provided in the paper feed tray 20, into the recesses 90.

<Transport Path 65>

As shown in FIG. 2, the transport path 65 is formed in the multifunction printer 10. The transport path 65 starts from the rear end of the paper feed tray 20, passes over the inclined surface 73, bends upward and frontward in the multifunction printer 10, passes below the recording section 24, and leads to the paper discharge tray 21. The recording paper 12 is fed by the paper feed roller 25 in the feeding orientation 17, past the inclined surface 73, and guided through the transport path 65 in a transport orientation. Here, the transport orientation is shown by the arrow of chain line in FIG. 2.

The transport path 65 is formed by an outer guide member 18 and an inner guide member 53 facing each other at an interval on the upstream side with respect to the recording section 24 in the transport orientation. Further, the transport path 65 is formed by an upper guide member 54 and a lower guide member 55 facing each other at an interval on the downstream side with respect to the recording section 24 in the transport orientation. Further, the outer guide member 18, inner guide member 53, upper guide member 54 and lower guide member 55 all extend in the left-right direction 9, i.e. in a direction perpendicular to the page of FIG. 2.

<Recording Section 24>

In this embodiment, the recording section 24 records images on the recording paper 12 in the ink-jet manner. As shown in FIG. 2, the recording section 24 includes a carriage 40 carrying a recording head 38 to move reciprocatingly in a main scanning direction (the left-right direction 9 perpendicular to the page of FIG. 2). The recording head 38 is supplied with ink from an ink cartridge (not shown). When the carriage 40 is moving reciprocatingly in the main scanning direction, the recording head 38 jets ink droplets from a plurality of nozzles 39 formed on its lower surface. By virtue of this, images are recorded on the recording paper 12 which is fed into the transport path 65 by the paper feed section 15, and supported by a platen 42 provided below the transport path 65 to face the recording section 24. Further, the method for the recording section 24 to record images on the recording paper 12 is not limited to the ink-jet manner, but may be, for example, an electrophotographic manner.

<First Roller Pair 58 and Second Roller Pair 59>

As shown in FIG. 2, a first roller pair 58 is provided on the upstream side with respect to the recording section 24 in the transport orientation. The first roller pair 58 includes a first transport roller 60 and a pinch roller 61. The first transport roller 60 is arranged above the transport path 65. The pinch roller 61 is arranged below the transport path 65. The pinch roller 61 is pressed against the roller surface of the first transport roller 60 by an unshown elastic member such as a spring or the like. The first roller pair 58 sandwiches the recording paper 12 fed in by the paper feed section 15, and sends the recording paper 12 onto the platen 42 positioned on the downstream side in the transport orientation.

A second roller pair 59 is provided on the downstream side with respect to the recording section 24 in the transport orientation. The second roller pair 59 includes a second transport roller 62 and a spur 63. The second transport roller 62 is arranged below the transport path 65. The spur 63 is arranged above the transport path 65. Similar to the pinch roller 61, the spur 63 is pressed against the second transport roller 62. The second roller pair 59 sandwiches the recording paper 12 transported by the first roller pair 58, and sends the recording paper 12 to the paper discharge tray 21 positioned on the downstream side in the transport orientation.

A drive force of a negative rotation direction (a counter-clockwise direction in FIG. 2) is transmitted from a transport motor (not shown) to the first transport roller 60 to rotate the first transport roller 60, while a drive force of a positive rotation direction (a clockwise direction in FIG. 2) is transmitted from the transport motor (not shown) to the second transport roller 62 to rotate the second transport roller 62.

<First Projective Portions 28>

As shown in FIGS. 3 and 4, the first projective portions 28 are formed at the rear end of the first loading plate 81 of the first tray 79. In this embodiment, the first projective portions 28 are provided in two places apart from each other in the left-right direction 9. In detail, each of the first projective portions 28 is provided almost midway between the center and one or the other end of the first loading plate 81 in the left-right direction 9.

These midway positions are configured to be contactable with the recording paper 12 in the minimum size loadable in the first tray 79. In this embodiment, the first projective portions 28 are provided at these positions such that if the recording paper of the size of 127 mm×89 mm is loaded with its short side along the left-right direction 9, then at least parts of the first projective portions 28 are present within the area where that short side is arranged. Further, in this embodiment, these midway positions are on the outside of the position of the paper feed roller 25 in the left-right direction 9. That is, the paper feed roller 25 is provided between the two positions at which the first projective portions 28 are provided in the left-right direction 9. Further, the positional relationship between the first projective portions 28 and the paper feed roller 25 is not limited to that described above.

Further, the number of the first projective portions 28 is not limited to two, but may be three or more. In such cases, the first projective portions 28 are provided at a plurality of different positions along the left-right direction 9. Further, it is also possible to provide only one first projective portion 28 rather than a plurality of first projective portions 28.

Each of the first projective portions 28 includes a first extending portion 31 extending rearward from the rear end of the first loading plate 81. Then, the main bodies of the first projective portions 28 are projected upward from the rear ends of the first extending portions 31, i.e. from the tip-ends of the first extending portions 31.

Figure 7B:
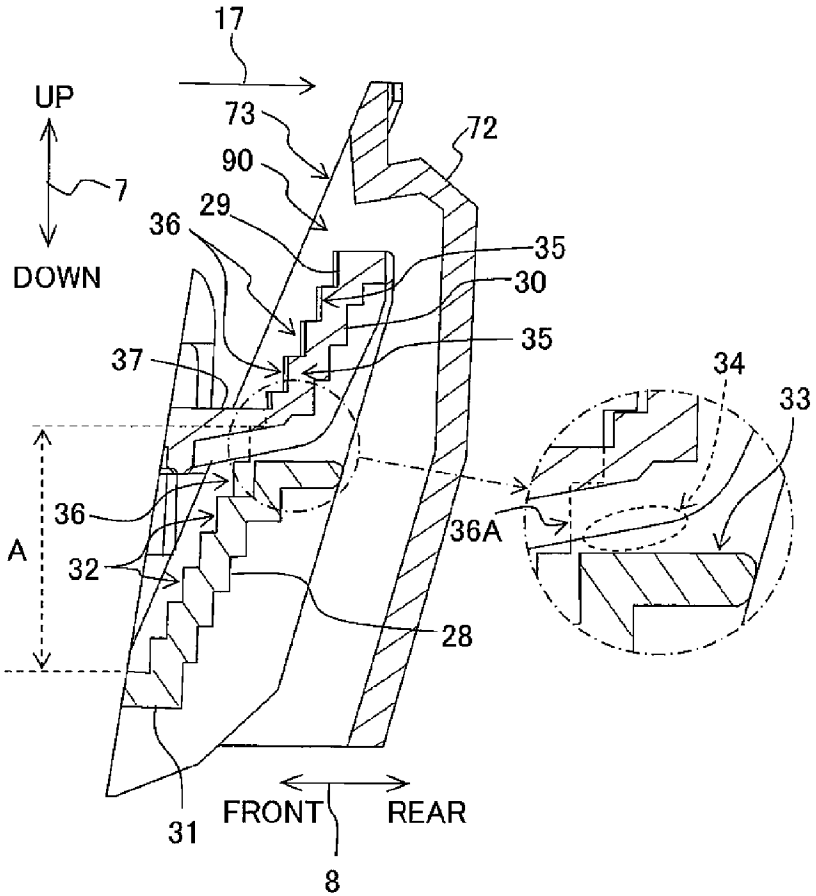
FIG. 7B is a cross-sectional view along the line VIIB-VIIB in FIG. 6.

In this embodiment, as shown in FIG. 7B, the part of the first projective portion 28 on the front side, i.e. on the upstream side in the feeding orientation 17, is projected obliquely upward and rearward from the tip-end of the first extending portion 31. That is, the part of the first projective portion 28 on the front side is inclined such that the upper end may be on the downstream side from the lower end in the feeding orientation 17. Further, in this embodiment, the part of the first projective portion 28 on the front side is step-like, and is constructed by the plurality of surfaces 32 orthogonal to the feeding orientation 17.

Further, as shown in FIG. 10, in the state that the paper feed tray 20 is at the first position, the first projective portions 28 are contained in the recesses 90 formed in the inclined surface 73 of the guide 72. On the other hand, as shown in FIG. 4, in the state that the paper feed tray 20 is at the second position, i.e. at a position away from the first position forward, because the first projective portions 28 are positioned in front of the recesses 90, they are not contained in the recesses 90. In the above manner, in the state that the paper feed tray 20 is at the first position, the first projective portions 28 are positioned on the downstream side with respect to the inclined surface 73 in the feeding orientation 17, whereas in the state that the paper feed tray 20 is at the second position, the first projective portions 28 are positioned on the upstream side with respect to the inclined surface 73 in the feeding orientation 17.

<Supporting Portions 33>

As shown in FIGS. 3, 4, and 7B, at the upper end of each of the first projective portions 28 of the first tray 79, a supporting portion 33 is formed to be capable of supporting the second tray 80. In this embodiment, the supporting portions 33 are upper surfaces of the first projective portions 28. Then, the upper surfaces, i.e. the supporting portions 33, are surfaces along the front-rear direction 8 and the left-right direction 9. Here in this embodiment, the lower surface of the second loading plate 84 of the second tray 80 is also a surface along the front-rear direction 8 and the left-right direction 9. That is, the supporting portions 33 are constructed by the flat surfaces along the lower surface of the second loading plate 84.

As described above, the first projective portions 28 are provided almost midway between the middle and both ends of the first loading plate 81, respectively. Here, the protruding portions 88 are formed to support the second tray 80 for the side plates 82 which stand upward from both ends of the first loading plate 81 in the left-right direction 9. That is, the supporting portions 33 formed as the upper surfaces of the first projective portions 28 are provided on the inside of the protruding portions 88 in the left-right direction 9.

On the other hand, as shown in FIG. 7B, the second tray 80 has a supported portion 34 supported by each of the supporting portions 33. The supported portion 34 is the lower surface of an aftermentioned second extending portion 37.

If the second tray 80 is at the third position, then the supported portion 34 faces the supporting portion 33. By virtue of this, the supported portion 34 is supported by the supporting portion 33. That is, if the second tray 80 is at the third position, then the supported portion 34 overlaps the supporting portion 33 in the feeding orientation 17. In other words, if the supporting portion 33 is positioned under the supported portion 34 and can support the supported portion 34, then the second tray 80 is at the third position.

On the other hand, if the second tray 80 is at the fourth position away from the third position, then the supported portion 34 is positioned in front of the supporting portion 33, i.e. on the upstream side in the feeding orientation 17. In this case, the supported portion 34 is not supported by the supporting portion 33. In other words, if the supporting portion 33 is not present under the supported portion 34 and cannot support the supported portion 34, then the second tray 80 is at the fourth position. In this embodiment, the fourth position refers to such a case that the supporting portion 33 is positioned on the downstream side from the supported portion 34 in the feeding orientation 17.

<Second Projective Portions 29>

As shown in FIGS. 3 and 4, the second projective portions 29 are formed at the rear end of the first loading plate 81 of the first tray 79. In this embodiment, the second projective portions 29 are provided in two places spaced in the left-right direction 9. In detail, the second projective portions 29 are provided at positions different from the first projective portions 28, i.e., adjacent to the first projective portions 28 on the outside of the first projective portions 28 in the left-right direction 9, respectively. Further, in this embodiment, almost half the lower surfaces of the second projective portions 29 on the inside in the left-right direction 9 are joined with the surfaces of the first projective portions 28 on the outside in the left-right direction 9. That is, the second projective portions 29 are each formed integrally with the first projective portions 28 into one body. The second projective portions 29 are formed at positions to be not contactable with the recording paper 12 in the minimum size loadable in the first tray 79, but to be contactable with the recording paper 12 larger than the minimum size. In this embodiment, the second projective portions 29 are positioned outside of the area where the short side is present when the recording paper 12 of the size of 127 mm×89 mm is loaded. In this case, the recording paper 12 in the minimum size is restricted in a smaller number of loading sheets than recording paper in other sizes so as not to go beyond the first projective portions 28. In particular, the recording paper 12 in the minimum size is restricted in the number of loading sheets by way of posting a notice about the restriction in the user's manual, or providing a sign on the paper feed tray 20 to indicate the number of loading sheets. Further, the first projective portions 28 and second projective portions 29, which are formed integrally, are an example of the projective portions of the present teaching.

Further, as will be described in an aftermentioned modification, the second projective portions 29 and the first projective portions 28 may also be formed not integrally but separately. Further, the number of the second projective portions 29 is not limited to two, but may be three or more. That is, the second projective portions 29 are provided at a plurality of different positions along the left-right direction 9. Further, it is also possible to provide only one second projective portion 29 but not a plurality of second projective portions 29.

Each of the second projective portions 29 includes the first extending portion 31 extending rearward from the rear end of the first loading plate 81. Then, the main bodies of the second projective portions 29 are projected upward from the rear ends of the first extending portions 31, i.e. the tip-ends of the first extending portions 31. That is, in this embodiment, the first projective portions 28 and the second projective portions 29 are projected upward from the tip-ends of the common first extending portions 31.

Figure 7A:
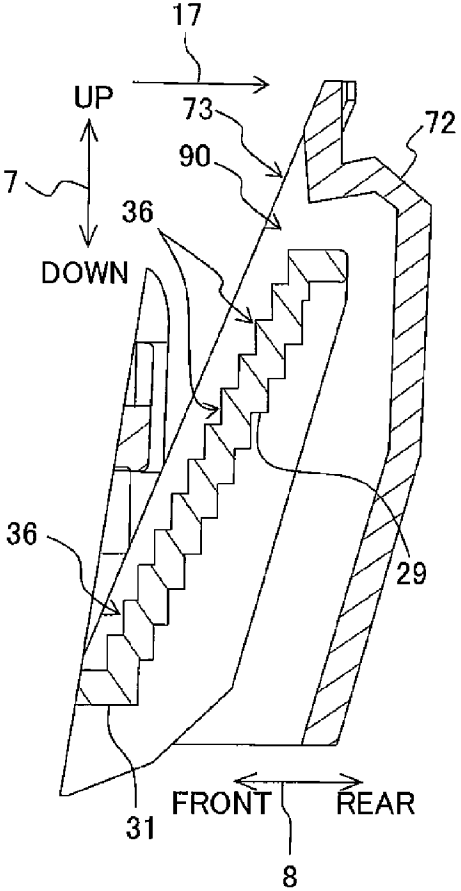
FIG. 7A is a cross-sectional view along the line VIIA-VIIA in FIG. 6

In this embodiment, as shown in FIG. 7A, the part of the second projective portion 29 on the front side, i.e. on the upstream side in the feeding orientation 17, is projected obliquely upward and rearward from the tip-end of the first extending portion 31. That is, the part of the second projective portion 29 on the front side is inclined such that the upper end may be on the downstream side from the lower end in the feeding orientation 17. Further, in this embodiment, the part of the second projective portion 29 on the front side is step-like, and is constructed by the plurality of surfaces 36 orthogonal to the feeding orientation 17. Further, in this embodiment, the plurality of surfaces 36 are situated at the same positions as the corresponding surfaces 32 of the first projective portions 28 in the front-rear direction 8, and situated in front of the corresponding surfaces 35 of the aftermentioned third projective portions 30 in the front-rear direction 8 in a state that the second tray 80 is at the third position.

Further, as shown in FIG. 10, if the paper feed tray 20 is at the first position, then the second projective portions 29 are contained in the recesses 90 formed in the inclined surface 73 of the guide 72. That is, each of the recesses 90 contains both of the integrally formed first projective portion 28 and second projective portion 29. On the other hand, as shown in FIG. 4, if the paper feed tray 20 is at the second position, i.e. at a position away from the first position forward, then because the second projective portions 29 are positioned away from the recesses 90 forward, they are not contained in the recesses 90. In the above manner, if the paper feed tray 20 is at the first position, then the second projective portions 29 are positioned on the downstream side from the inclined surface 73 in the feeding orientation 17, whereas if the paper feed tray 20 is at the second position, then the second projective portions 29 are positioned on the upstream side to the inclined surface 73 in the feeding orientation 17. Therefore, if the recording paper 12 is loaded on the first loading plate 81 of the first tray 79, then the first projective portions 28 and the second projective portions 29 contact with the tip-end of the recording paper 12 when the paper feed tray 20 is at the second position. By virtue of this, it is possible to prevent the recording paper 12 from going out from the first tray 79. Further, if the paper feed tray 20 is at the first position, then the inclined surface 73 contacts with the tip-end of the recording paper 12.

As shown in FIGS. 3 and 4, the second projective portions 29 project above the supporting portions 33. Especially in this embodiment, as shown in FIG. 5, the second projective portions 29 project not only above the supporting portions 33 but also above the second loading plate 84. If the second loading plate 84 has loaded the recording paper 12 in the maximum size loadable on the second loading plate 84 of the second tray 80, then the positions of the second projective portions 29 in the left-right direction 9 are almost in conformity with the positions of both the left and right ends of the recording paper 12.

As shown in FIG. 7B, the surfaces 36 of the second projective portions 29 on the front side are, in the range A, positioned in front of the supporting portions 33, i.e. on the upstream side in the feeding orientation 17. Therefore, the surfaces 36 contact with the back-end of the recording paper 12 loaded on the first loading plate 81, i.e. with the downstream end in the feeding orientation 17. Further, the range A includes, in the up-down direction 7, higher positions than the supporting portions 33, the same position as the supporting portions 33, and lower positions than the supporting portions 33. In the above manner, at least from the position as high as the supporting portions 33 to positions higher than the supporting portions 33, the surfaces 36 of the second projective portions 29 on the front side contact with the tip-end of the recording paper 12 positioned on the upstream side to the supporting portions 33 in the feeding orientation 17.

One of the surfaces 36 of each of the second projective portions 29 on the front side has a surface 36A (see FIG. 7B) which extends from a position as high as the supporting portions 33 to a position higher than the supporting portions 33 in front of the supporting portions 33, and intersects the feeding orientation 17. Further, the surface 36A is an example of the contact portion of the present teaching.

<Third Projective Portions 30>

As shown in FIGS. 4 and 5, the third projective portions 30 are formed at the rear end of the second loading plate 84 of the second tray 80. In this embodiment, the third projective portions 30 are provided in two places spaced in the left-right direction 9. In detail, the third projective portions 30 are, as shown in FIG. 6, provided at the equivalent positions to the first projective portions 28 in the left-right direction 9. Further, the third projective portions 30 are formed to be contactable with the recording paper 12 in the minimum size loadable in the second tray 80. In this embodiment, in the same manner as with the first tray 79, the third projective portions 30 are provided at such positions that if the recording paper 12 of the size of 127 mm×89 mm is loaded with its short side along the left-right direction 9, then at least parts of the third projective portions 30 are present within the area where that short side is arranged.

Further, the number of the third projective portions 30 is not limited to two, but may be three or more. In such cases, the third projective portions 30 are provided at a plurality of different positions along the left-right direction 9. Further, it is also possible to provide only one third projective portion 30 but not a plurality of third projective portions 30.

Each of the third projective portions 30 includes the second extending portion 37 extending rearward from the rear end of the second loading plate 84. Then, the main bodies of the third projective portions 30 are projected upward from the rear ends of the second extending portions 37, i.e. from the tip-ends of the second extending portions 37.

In this embodiment, as shown in FIG. 7B, the part of the third projective portion 30 on the front side, i.e. on the upstream side in the feeding orientation 17, is projected obliquely upward and rearward from the tip-end of the second extending portion 37. That is, the part of the third projective portion 30 on the front side is inclined such that the upper end may be on the downstream side from the lower end in the feeding orientation 17. Further, in this embodiment, the part of the third projective portion 30 on the front side is step-like, and is constructed by the plurality of surfaces 35 orthogonal to the feeding orientation 17.

Further, as shown in FIG. 11, if the paper feed tray 20 is at the first position while the second tray 80 is at the third position, then the third projective portions 30 are contained in the recesses 90 formed in the inclined surface 73 of the guide 72. On the other hand, if the paper feed tray 20 is at the second position, i.e. at a position in front of the first position (see FIG. 5), or if the second tray 80 is at the fourth position (see FIG. 4), then because the third projective portions 30 are positioned in front of the recesses 90, they are not contained in the recesses 90. In the above manner, if the second tray 80 is at the third position, then the third projective portions 30 are positioned on the downstream side from the inclined surface 73 of the guide 72 in the feeding orientation 17. Therefore, if the recording paper 12 is loaded on the second loading plate 84 of the second tray 80, then the third projective portions 30 contact with the tip-end of the recording paper 12 when the paper feed tray 20 is at the second position. By virtue of this, it is possible to prevent the recording paper 12 from going out from the second tray 80. Further, if the paper feed tray 20 is at the first position while the second tray 80 is at the third position, then the inclined surface 73 of the guide 72 contacts with the tip-end of the recording paper 12.

As shown in FIG. 7B, if the second tray 80 is at the third position, then the third projective portions 30 are at almost the equivalent positions to the first projective portions 28 in the front-rear direction 8. Further, as described above, the third projective portions 30 are provided at the equivalent positions to the first projective portions 28 in the left-right direction 9 (see FIG. 6). In the above manner, the third projective portions 30 are provided above the first projective portions 28 of the first tray 79 when the second tray 80 is at the third position. Because the second tray 80 is plate-like, and is supported by the first tray 79 on both left and right end portions, its middle part in the left-right direction 9 is liable to bend due to the weight of the loaded recording paper 12, the contact with the paper feed roller 25, paper feed arm 26 and the like, the force exerted when the user is moving the second tray 80, etc. FIG. 7B shows the second tray 80 in an unbent state. Therefore, the supporting portion 33 is apart from the supported portion 34.

However, if the second tray 80 bends as described above, then the lower surface of the second extending portion 37 of the third projective portion 30 is supported by the supporting portion 33 which is the upper surface of the first projective portion 28. That is, the lower surface of the second extending portion 37 of the third projective portion 30 is the aforementioned supported portion 34. The supported portion 34 is an area supportable by the supporting portion 33. Further, as a matter of course, it is also possible to configure the supporting portion 33 and the supported portion 34 such that the supporting portion 33 may constantly support the supported portion 34 even if the second tray 80 does not bend.

As described above, if the second tray 80 is at the third position, then the third projective portions 30 are at almost the equivalent positions to the first projective portions 28 in the front-rear direction 8 (see FIG. 7B). Further, as described above, the third projective portions 30 are provided at the equivalent positions to the first projective portions 28 in the left-right direction 9 (see FIG. 6). Further, as described above, the second projective portions 29 are provided adjacent to the first projective portions 28 on the outside of the first projective portions 28 in the left-right direction 9 (see FIG. 6). In other words, the first projective portions 28 are adjacent to the second projective portions 29 on the inside of the second projective portions 29 in the left-right direction 9. Therefore, if the second tray 80 is at the third position, then the third projective portions 30 and the second projective portions 29 are provided at adjacent positions in the left-right direction 9.

<Contacts of the Recording Paper 12 with the First Projective Portions 28, Second Projective Portions 29, and Third Projective Portions 30>

The following explanation will refer to the contacts of the uppermost sheet of the recording paper 12 with the first projective portions 28 and second projective portions 29 in a case that sheets of the recording paper 12 are loaded on the first loading plate 81 of the first tray 79 at nearly the maximum loading capacity, that the paper feed tray 20 is at the second position, and that the second tray 80 is at the fourth position, in this embodiment.

In this embodiment, as described above, each of the frontal parts of the first projective portions 28, second projective portions 29 and third projective portions 30 is step-like, and is constructed respectively by the plurality of surfaces 32, surfaces 36 and surfaces 35.

Figure 9A:
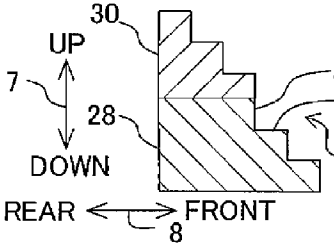
FIG. 9A is a cross-sectional view along the line IXA-IXA in FIG. 8A.
Figure 9B:
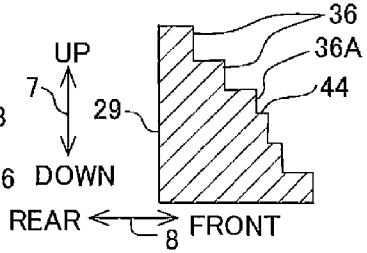
FIG. 9B is a cross-sectional view along the line IXB-IXB in FIG. 8A.
Figure 9C:
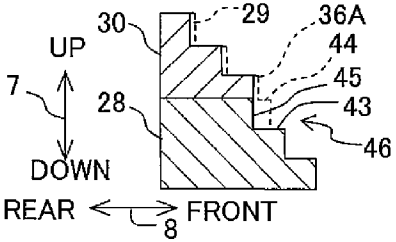

Here as shown in FIGS. 9B and 9C, at the position equivalent in height to the lower end of the surface 36A of the second projective portion 29, the second projective portion 29 has a surface 44, i.e. a horizontal surface of the step, expanding in the front-rear direction 8 and the left-right direction 9. In other words, each of the second projective portions 29 has the surface 44 extending frontward from the position equivalent in height to the lower end of the surface 36A (an example of the third extending portion of the present teaching).

Further, as shown in FIGS. 9A and 9C, at the position corresponding to the surface 44 of the second projective portion 29 in the front-rear direction 8, the first projective portion 28 has a surface 45, i.e. a vertical surface of the step, expanding in the up-down direction 7 and the left-right direction 9. In other words, each of the first projective portions 28 has such a recess 46 that the portion corresponding to the surface 44 of the second projective portion 29 in the front-rear direction 8 dents downward below the surface 44 (an example of the recess of the present teaching). That is, the above surface 45 constitutes a lateral surface of the recess 46.

Figure 8A:
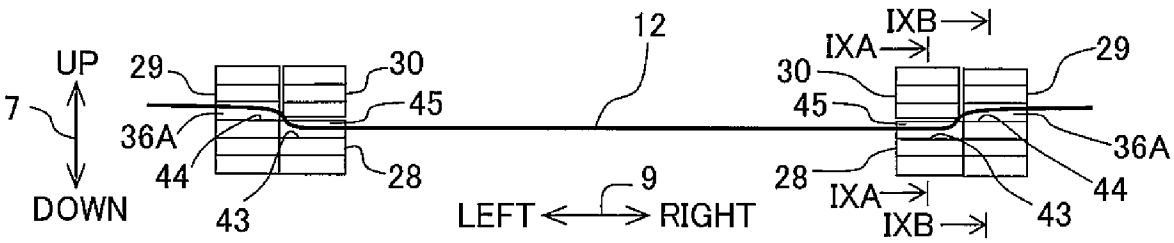
FIGS. 8A to 8C are front views schematically showing first projective portions, second projective portions, third projective portions, and a sheet of recording paper.
Figure 8B:
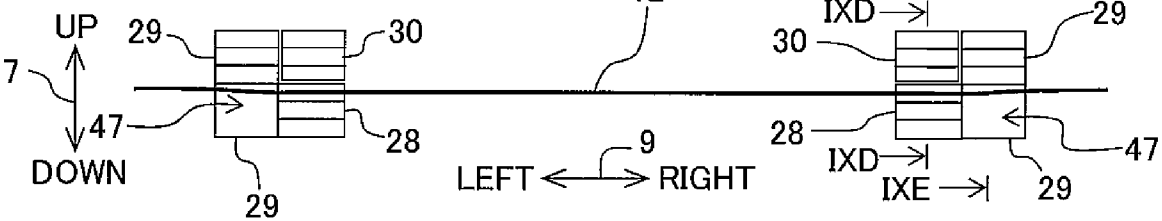

If the second tray 80 at the fourth position moves relative to the first tray 79 along the feeding orientation 17 to come to the third position, then the uppermost sheet of the recording paper 12 loaded on the first loading plate 81 is subjected to moving in the feeding orientation 17 along with the lower surface of the second tray 80. Then, due to the above construction of the first projective portions 28 and second projective portions 29, the uppermost sheet of the recording paper 12 loaded on the first loading plate 81 contacts with the surface 36A and bends downward, as shown in FIG. 8A, on the inside of the borders between the first projective portions 28 and the second projective portions 29 in the left-right direction 9.

This is due to the following reason. That is, the uppermost sheet of the recording paper 12 loaded at nearly the maximum loading capacity is positioned almost as high as the supporting portions 33 in the up-down direction 7. Thereby, the uppermost sheet of the recording paper 12 is supported by the surfaces 44 at the positions of the second projective portions 29 in the left-right direction 9. On the other hand, the uppermost sheet of the recording paper 12 is supported by bottom surfaces 43 of the recesses 46 at the positions of the first projective portions 28 in the left-right direction 9. Then, because the bottom surfaces 43 are lower in height than the surfaces 44, the uppermost sheet of the recording paper 12 bends such that its middle portion is positioned to be lower than both end portions in the left-right direction 9.

[Effects of the Embodiment]

According to the above embodiment, the first tray 79 includes the second projective portions 29 in addition to the first projective portions 28. Here, the second projective portions 29 respectively have the surfaces 36A which are arranged on the upstream side to the supporting portions 33 in the feeding orientation 17 at least from the positions as high as the supporting portions 33 to positions higher than the supporting portions 33. Therefore, even if the recording paper 12 loaded on the first loading plate 81 moves to follow the movement of the second tray 80 relative to the first tray 79 along the feeding orientation 17, and attempts to ride on the supporting portions 33 at the upper ends of the first projective portions 28, the recording paper 12 still contacts with the surfaces 36A of the second projective portions 29. That is, the surfaces 36A of the second projective portions 29 can restrain the recording paper 12 from riding on the supporting portions 33. By virtue of this, even if the recording paper 12 loaded on the first loading plate 81 of the first tray 79 moves to follow the movement of the second tray 80, it is still possible to lower the possibility of being caught between the supporting portions 33 and the supported portions 34. If the recording paper 12 rode on the supporting portions 33, then with the supporting portions 33 supporting the supported portions 34 in this rode-on state, the recording paper 12 would possibly be caught there and suffer crinkle and damage. However, this can be prevented according to the above embodiment. Further, it is possible to prevent the ride-on of not only the uppermost sheet of the recording paper 12 but also a plurality of sheets of the recording paper 12 from the top.

Further, according to the above embodiment, the surfaces 36A of the second projective portions 29 are configured to intersect the feeding orientation 17. According to this configuration, the surfaces 36A of the second projective portions 29 can reliably restrain the recording paper 12 from riding on the supporting portions 33.

Further, according to the above embodiment, because the second projective portions 29 extend above the first projective portions 28, the second projective portions 29 can reliably restrain the recording paper 12 loaded on the first loading plate 81 from riding on the supporting portions 33.

Further, according to the above embodiment, because each pair of the first projective portions 28 and second projective portions 29 are formed integrally into one body, the first projective portions 28 and second projective portions 29 can be easily formed or molded. Further, according to the above embodiment, it is possible to reduce the space occupied by the first projective portions 28 and second projective portions 29.

Further, according to the above embodiment, because the inclined surface 73, first projective portions 28 and second projective portions 29 are inclined at a gradient of the same orientation, it is possible to reduce the necessary movement amount of the first tray 79 in order to position the first projective portions 28 and second projective portions 29 in the feeding orientation 17 on the downstream side from the inclined surface 73 in the feeding orientation 17.

Further, according to the above embodiment, because the first projective portions 28 and the second projective portions 29 are respectively provided at a plurality of (two) different places along the left-right direction 9, the first projective portions 28 and the second projective portions 29 contact with the recording paper 12 over a wide range in the left-right direction 9. By virtue of this, it is possible to reduce the possibility that the recording paper 12 loaded on the first loading plate 81 may fall out of the first tray 79 at the second position. Further, according to the above embodiment, because the second projective portions 29 contact with the recording paper 12 over a wide range, it is possible to reduce the possibility that the recording paper 12 loaded on the first loading plate 81 may ride on the supporting portions 33 of the first projective portions 28.

Further, according to the above embodiment, because the second projective portions 29 are provided on the outside of the first projective portions 28 in the left-right direction 9, if the recording paper 12 loaded on the first loading plate 81 bends the more upward on the further outside in the left-right direction 9, then it is possible to reduce the possibility that the recording paper 12 may ride on the supporting portions 33 of the first projective portions 28.

Further, according to the above embodiment, because the supporting portions 33 are constructed by the flat surfaces along the lower surface of the second loading plate 84, the supporting portions 33 can support the second tray 80 in such a state as to easily feed the recording paper 12 loaded on the second loading plate 84 of the second tray 80.

Further, according to the above embodiment, if the second tray 80 is at the fourth position, then the third projective portions 30 restrain the recording paper 12 loaded on the second loading plate 84 from moving in the feeding orientation 17. By virtue of this, if the second tray 80 is at the fourth position, then it is possible to reduce the possibility that the recording paper 12 loaded on the second loading plate 84 may fall out of the second tray 80.

Further, according to the above embodiment, because the third projective portions 30 are provided above the first projective portions 28, it is possible to situate the first projective portions 28 and third projective portions 30 at equivalent positions in the left-right direction 9, respectively. By positioning the two projective portions close to each other, it is possible to easily realize such a configuration for this feeding apparatus that the two projective portions are on the downstream side from the inclined surface 73 in the feeding orientation 17.

Further, according to the above embodiment, by contact of the third projective portions 30 with the second projective portions 29, the second tray 80 is restrained from moving in the left-right direction 9. That is, it is possible to position the second tray 80 in the left-right direction 9.

Further, according to the above embodiment, because the inclined surface 73 and third projective portions 30 are inclined at a gradient of the same orientation, it is possible to reduce the necessary movement amount of the second tray 80 in order to position the third projective portions 30 in the feeding orientation 17 on the downstream side from the inclined surface 73 in the feeding orientation 17.

Further, according to the above embodiment, the surfaces 44 of the second projective portions 29 right below the surfaces 36A support the recording paper 12 on its portions against the second projective portions 29 in the left-right direction 9. Further, according to the above embodiment, the first projective portions 28 dent downward below the surfaces 44 in the portions corresponding to the surfaces 44 of the second projective portions 29 in the front-rear direction 8. Therefore, the recording paper 12 is subjected to bending along the left-right direction 9. Because the bending of the recording paper 12 increases the rigidity of the recording paper 12 itself, it is possible to reduce the possibility that the recording paper 12 may inflect along the feeding orientation 17 when the second tray 80 is moving.

Further, according to the above embodiment, the second tray 80 is supported by the protruding portions 88 and supporting portions 33. That is, the second tray 80 is supported on at least three places at its both ends in the left-right direction 9 and on the inside of the both ends in the left-right direction 9. Therefore, it is possible to restrain the second tray 80 from bending along the left-right direction 9.

Further, according to the above embodiment, because the paper feed section 15 contacts with the second tray 80 from above, the second tray 80 has a tendency to bend. Even so, because the second tray 80 is supported by the first projective portions 28 from below on both sides of the position in contact with the paper feed section 15 in the left-right direction 9, the second tray 80 is restrained from bending.

[First Modification]

Although the first projective portions 28, second projective portions 29 and third projective portions 30 are all projected obliquely upward and rearward in the above embodiment, they may alternatively not extend obliquely upward and rearward. For example, the first projective portions 28, second projective portions 29 and third projective portions 30 may instead extend either obliquely upward and frontward or just upward.

[Second Modification]

In the above embodiment, when the second tray 80 is at the third position, the second projective portions 29 and third projective portions 30 are provided to be respectively adjacent to each other in the left-right direction 9. Then, by virtue of this, the second tray 80 is positioned in the left-right direction 9. However, the second tray 80 may also be positioned in the left-right direction 9 by other ways than by contact with the second projective portions 29.

Figure 12A:
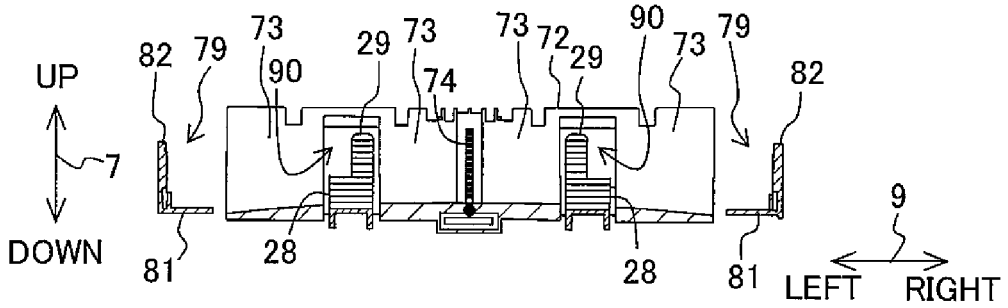
FIGS. 12A to 12D are front views of the guide, the first projective portions and the second projective portions.
Figure 12B:
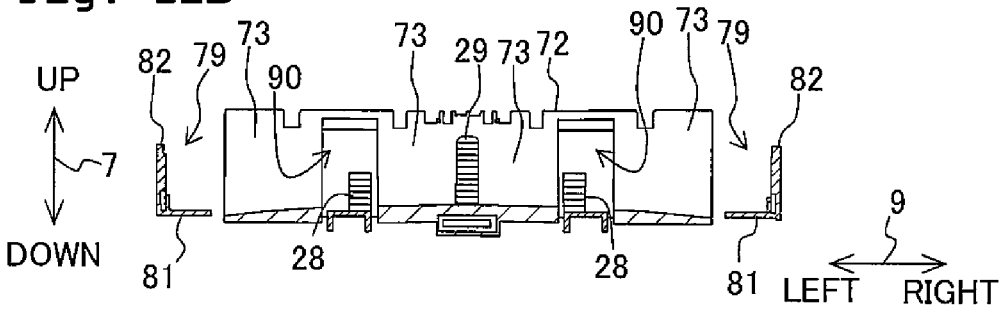
Figure 12C:
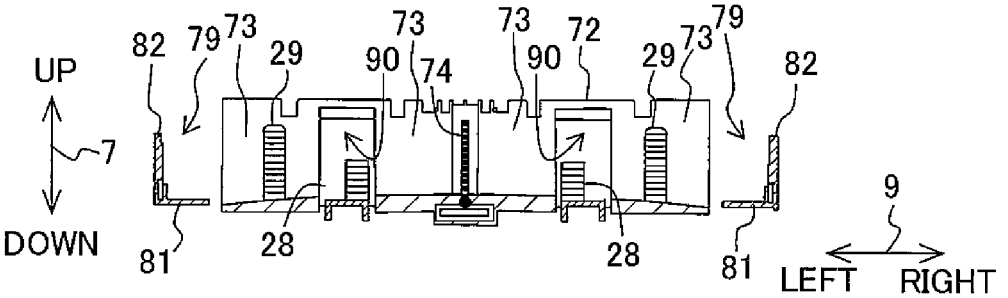
Figure 12D:
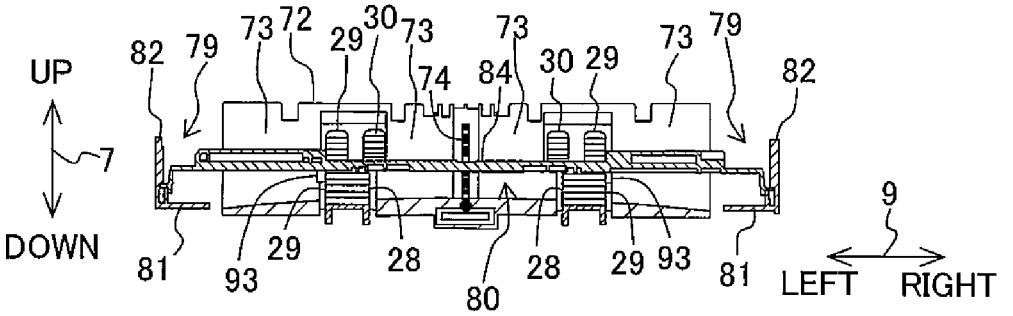

As shown in FIG. 12D, for example, the second projective portions 29 may be positioned in the left-right direction 9 by lateral contact portions 93 projected downward from the lower surface of the second tray 80. The lateral contact portions 93 are provided respectively at adjacent positions to the second projective portions 29 when the second tray 80 is at the third position.

According to the second modification, by the contact between the lateral contact portions 93 and the lateral parts of the second projective portions 29, the second tray 80 is restrained from moving in the left-right direction 9. That is, it is possible to position the second tray 80 in the left-right direction 9.

[Third Modification]

As shown in FIGS. 3 and 6 in the above embodiment, the first projective portions 28 are arranged on the inside of the second projective portions 29 in the left-right direction 9. However, the positional relationship between the first projective portions 28 and the second projective portions 29 is not limited to that of the above embodiment. As shown in FIG. 12A, for example, the first projective portions 28 may also be arranged on the outside of the second projective portions 29 in the left-right direction 9.

Further, as shown in FIGS. 3 and 4 in the above embodiment, each pair of the first projective portions 28 and second projective portions 29 are formed integrally into one body. However, each pair of the first projective portions 28 and second projective portions 29 may also not be formed integrally into one body.

As shown in FIG. 12B, for example, one second projective portion 29 may be formed in the middle of the two first projective portions 28, i.e. in the middle part of the first loading plate 81. Further, as shown in FIG. 12C, the second projective portions 29 may also be formed respectively on the outside away from the two first projective portions 28.

Of course, the first projective portions 28 and the second projective portions 29 may also be arranged at other positions than those shown in FIGS. 12A, 12B and 12C.

[Fourth Modification]

In the above embodiment, the frontal parts of the first projective portions 28, the frontal parts of the second projective portions 29 and the frontal parts of the third projective portions 30 are all formed to be step-like such that the upper ends may be in back of the lower ends. However, the frontal parts of the first projective portions 28, the frontal parts of the second projective portions 29 and the frontal parts of the third projective portions 30 need not be all step-like but, for example, some of the frontal parts of the first projective portions 28, second projective portions 29 and third projective portions 30 may be not step-like. Especially, except for the area corresponding to the contact portion of the present teaching (the surface 36A which is part of the frontal surface 36 of each of the second projective portions 29 in the above embodiment), other areas may be not step-like.

Figure 9D:
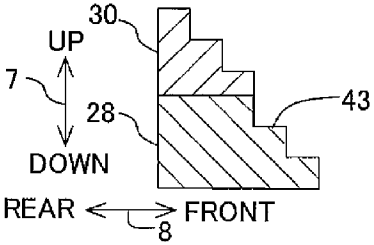
FIG. 9D is a cross-sectional view along the line IXD-IXD in FIG. 8B.
Figure 9E:
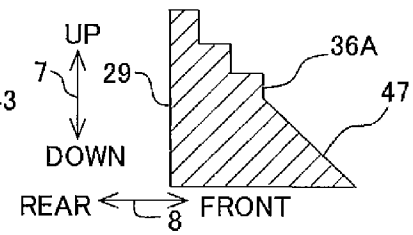
FIG. 9E is a cross-sectional view along the line IXE-IXE in FIG. 8B.
Figure 9F:
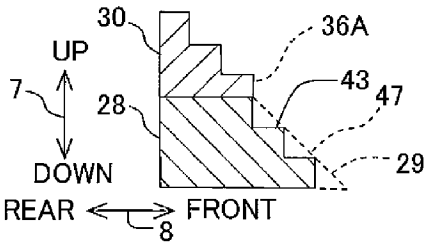
Figure 9G:
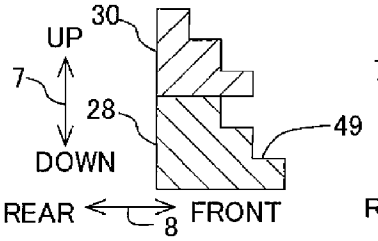
FIG. 9G is a cross-sectional view along the line IXG-IXG in FIG. 8C.

As shown in FIG. 9E, for example, the second projective portion 29 may also have an inclined surface 47 (an example of the inclined surface of the present teaching) downward from the position equivalent in height to the lower end of the surface 36A (see FIG. 9D) of the second projective portion 29. Here, the inclined surface 47 is inclined such that the upper end may be positioned in the rear of the lower end. Then, in this case, as shown in FIG. 9F, the part of the first projective portion 28 corresponding to the inclined surface 47 in the front-rear direction 8, i.e. the frontal part of the first projective portion 28, is positioned in the rear of the inclined surface 47.

With the first projective portions 28 and the second projective portions 29 configured in the above manner, the uppermost sheet of the recording paper 12 loaded on the first loading plate 81 bends downward on the inside of the borders between the first projective portions 28 and the second projective portions 29 in the left-right direction 9. However, the bending of the recording paper 12 is moderated more than that in the above embodiment.

This is due to the following reason. That is, the uppermost sheet of the recording paper 12 loaded at the maximum loading capacity is positioned almost as high as the supporting portions 33 in the up-down direction 7. By virtue of this, the uppermost sheet of the recording paper 12 is supported by the inclined surfaces 47 at the positions against the second projective portions 29 in the left-right direction 9. On the other hand, the uppermost sheet of the recording paper 12 is also supported by the bottom surfaces 43 of the recesses 46 at the positions against the first projective portions 28 in the left-right direction 9. In such a state, this sheet of the recording paper 12 is slid downward along the inclined surfaces 47 at the positions of the second projective portions 29 in the left-right direction 9. Therefore, the bending of the recording paper 12 is moderated more than that in the above embodiment.

According to the fourth modification, it becomes easy for the recording paper 12 in contact with the surfaces 36A to fall downward along the inclined surfaces 47. By virtue of this, it is possible to reduce the possibility that the recording paper 12 may ride on the supporting portions 33.

[Fifth Modification]

Figure 9H:
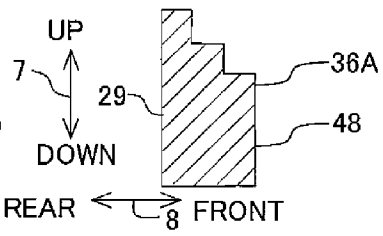
FIG. 9H is a cross-sectional view along the line IXH-IXH in FIG. 8C.

Besides the fourth modification, FIG. 9H shows another example that the second projective portion 29 may also form a continuous surface 48 which extends continuously downward from the position equivalent in height to the lower end of the surface 36A of the second projective portion 29. Here, the continuous surface 48 is a surface along the surface 36A of the second projective portion 29. That is, each of the continuous surfaces 48 stands vertically to any surface expanding in the front-rear direction 8 and the left-right direction 9. Further, if the surfaces 36A of the second projective portions 29 are inclined surfaces, then the continuous surfaces 48 become inclined surfaces too.

Further, in the fifth modification, like the above embodiment, the first projective portions 28 are respectively adjacent to the second projective portions 29 on the inside of the second projective portions 29 in the left-right direction 9.

Figure 9I:
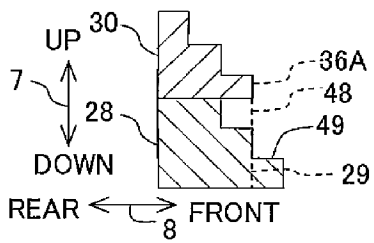

Further, in the fifth modification, as shown in FIG. 9I, the first projective portion 28 has a surface 49 (an example of the fourth extending portion of the present teaching), i.e. a horizontal surface of the step, expanding in the front-rear direction 8 and the left-right direction 9 in front of the surface 36A in the front-rear direction 8 and below the surface 36A of the second projective portion 29.

With the first projective portions 28 and the second projective portions 29 configured in the above manner, the uppermost sheet of the recording paper 12 loaded on the first loading plate 81 bends upward on the inside of the borders between the first projective portions 28 and the second projective portions 29 in the left-right direction 9.

Figure 8C:
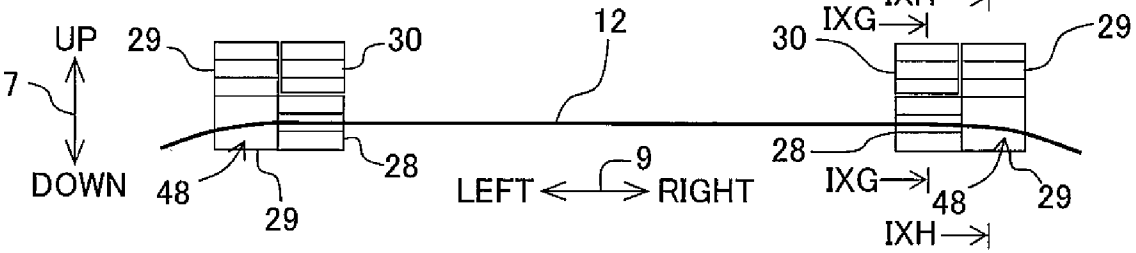

This is due to the following reason. That is, the uppermost sheet of the recording paper 12 loaded at the maximum loading capacity is positioned almost as high as the supporting portions 33 in the up-down direction 7. However, because the continuous surfaces 48 stand vertically to any surface expanding in the front-rear direction 8 and the left-right direction 9, the uppermost sheet of the recording paper 12 is not supported by the continuous surfaces 48 at the positions of the second projective portions 29 in the left-right direction 9. On the other hand, the uppermost sheet of the recording paper 12 is supported by the surfaces 49 at the positions of the first projective portions 28 in the left-right direction 9. Therefore, as shown in FIG. 8C, the recording paper 12 bends upward on the inside of the borders between the first projective portions 28 and the second projective portions 29 in the left-right direction 9.

According to the fifth modification, the portions of the recording paper 12 against the second projective portions 29 in the left-right direction 9 move downward along the continuous surfaces 48 formed on the second projective portions 29. Further, the surfaces 49 of the first projective portions 28 support the moved recording paper 12. Therefore, the recording paper 12 is bent along the left-right direction 9. By the bending of the recording paper 12, it is possible to reduce the possibility that the recording paper 12 may inflect along the feeding orientation 17 when the second tray 80 is moving.

[Sixth Embodiment]

In the above embodiment, the first projective portions 28, second projective portions 29 and third projective portions 30 are formed to incline at a step-like gradient. However, they may also be formed not to incline if they are configured to be capable of stopping the tip-end of the recording paper 12.

[Seventh Embodiment]

The second projective portions 29 may not project so high as above the second loading plate 84, but extend as high as above the maximum loading height of the recording paper 12 loaded in the first tray 79.

[Eighth Embodiment]

In the above embodiment, every one of the first projective portions 28, second projective portions 29 and third projective portions 30 respectively has the multiple frontal surfaces 32, surfaces 36 and surfaces 35 which are each constructed by a surface orthogonal to the feeding orientation 17. However, as a matter of course, other shapes are also adoptable. For example, they may each not be surface-like, but have any shape which intersects the feeding orientation 17 at a certain angle, and contacts with the tip-end of the recording paper 12 to inhibit the same from further movement.

[Ninth Embodiment]

The guide 72 need not be formed by one member, but the inclined surface 73 may be formed by every one of a plurality of members provided apart from each other in the left-right direction 9 so as to form such a space that each of the projective portions 28, 29 and 30 may be positioned on the downstream side from the inclined surface 73 in the feeding orientation 17.

[Tenth Embodiment]

In the above embodiment, as shown in FIGS. 7A, 7B and 9C, the positions of the plurality of surfaces 36 of each of the second projective portions 29 in the front-rear direction 8 are in front of the positions of the corresponding surfaces 35 of each of the third projective portions 30 in the front-rear direction 8, but at the equivalent positions to the corresponding surfaces 32 of each of the first projective portions 28 in the front-rear direction 8. However, the positions of the surfaces 35 and 32 corresponding respectively to the plurality of surfaces 36 in the front-rear direction 8 may either be at equivalent positions or deviate from each other in the front-rear direction 8. Further, each horizontal surface of the step of the second projective portions 29 may either be positioned at the same height as each horizontal surface of the step of the corresponding first projective portions 28 or third projective portions 30 in the up-down direction 7, or deviate from one another in the up-down direction 7.

What is claimed is:

1. A feeding apparatus configured to feed sheets, the apparatus comprising:

an apparatus main body;

a feeding section configured to feed the sheets in a feeding orientation;

a first tray configured to be movable relative to the apparatus main body along the feeding orientation between a first position at which the feeding section can feed the sheets and a second position at which the feeding section cannot feed the sheets, and comprising:

a first loading plate for loading some of the sheets;

a first projective portion which projects upward from an end portion of the first loading plate on the downstream side in the feeding orientation and which has a supporting portion on its upper end; and a second projective portion which projects upward from the end portion of the first loading plate on the downstream side in the feeding orientation at a position different from the first projective portion in a width direction perpendicular to the feeding orientation and which has a contact portion, which is positioned on the upstream side with respect to the supporting portion of the first projective portion in the feeding orientation at least from a position as high as the supporting portion to a position higher than the supporting portion, a second tray provided above the first tray and comprising a second loading plate for loading the other of the sheets, the second loading plate having a supported portion configured to be supported by the supporting portion, the second tray being movable relative to the first tray along the feeding orientation between a third position at which the feeding section can feed the other of the sheets and the supported portion overlaps with the supporting portion in the feeding orientation and a fourth position at which the feeding section cannot feed the other of the sheets and the supported portion is on the upstream side with respect to the supporting portion in the feeding orientation; and a guide provided in the apparatus main body and having a guide surface for guiding the sheets, which are fed by the feeding section from one of the first tray and which make contact with the guide surface;

wherein in a state that the first tray is positioned at he first position, the first projective portion and the second projective portion are positioned on the downstream side of the guide surface in the feeding orientation, and in a state hat the first tray is positioned at the second position, the first projective portion and the second projective portion are positioned on the upstream side of the guide surface in the feeding orientation.

2. The feeding apparatus according to claim 1, wherein the contact portion has a surface which is provided at a position on the upstream side with respect to the supporting portion in the feeding orientation, extends from the position as high as the supporting portion to the position higher than the supporting portion, and intersects with the feeding orientation.

3. The feeding apparatus according to claim 1, wherein the first projective portion and the second projective portion are integrally formed.

4. The feeding apparatus according to claim 1, wherein the second tray includes a lateral contact portion which makes contact with a lateral part of the second projective portion in a state that the second tray is at the third position.

5. The feeding apparatus according to claim 1, wherein the guide surface is inclined such that an upper end thereof is on the downstream side with respect to a lower end thereof in the feeding orientation; and upstream side in the feeding orientation of each of the first projective portion and the second projective portion is inclined such that upper end thereof is on the downstream side with respect to a lower end thereof in the feeding orientation.

6. The feeding apparatus according to claim 1, wherein at least one of the first projective portion and the second projective portion is provided at each of a plurality of different positions along the width direction.

7. The feeding apparatus according to claim 1, wherein the first projective portion is provided as two first projective portions at two different positions in the width direction respectively, and the second projective portion is provided as two second projective portions outside of the two first projective portions in the width direction.

8. The feeding apparatus according to claim 1, wherein the supporting portion is constructed by a flat surface along a lower surface of the second loading plate.

9. The feeding apparatus according to claim 1, wherein the first projective portion and the second projective portion have a first extending portion extending from the first loading plate toward the downstream side in the feeding orientation, and project upward from a tip-end of the first extending portion.

10. The feeding apparatus according to claim 1, wherein the second tray includes a third projective portion which projects upward from an end portion of the second loading plate on the downstream side in the feeding orientation, and in a state that the second tray is at the third position, the third projective portion is positioned on the downstream side with respect to the contact portion in the feeding orientation.

11. The feeding apparatus according to claim 10, wherein the third projective portion has the supported portion, and the third projective portion is provided to be positioned above the first projective portion of the first tray in the state that the second tray is at the third position.

12. The feeding apparatus according to claim 10, wherein the third projective portion has a second extending portion extending from the second loading plate toward the downstream side in the feeding orientation, and the third projective portion projects upward from a tip-end of the second extending portion.

13. The feeding apparatus according to claim 10, wherein the third projective portion is provided to be adjacent to the second projective portion in the width direction in the state that the second tray is at the third position.

14. The feeding apparatus according to claim 10, wherein the guide surface is inclined such that an upper end thereof is on the downstream side with respect to a lower end thereof in the feeding orientation, and upstream side in the feeding orientation of the third projective portion is inclined such that an upper end thereof is on the downstream side with respect to a lower end thereof in the feeding orientation.

15. The feeding apparatus according to claim 1, wherein the first projective portion is adjacent to the second projective portion, the second projective portion has a third extending portion extending from a lower end of the contact portion toward the upstream side in the feeding orientation, and the first projective portion has a recess which corresponds to the third extending portion in the feeding orientation and which dents downward below the third extending portion.

16. The feeding apparatus according to claim 1, wherein the second projective portion has an inclined surface which is continuous from a lower end of the contact portion and inclined such that an upper end thereof is positioned on the downstream side with respect to a lower end thereof in the feeding orientation, and the first projective portion has a portion which corresponds to the inclined surface in the feeding orientation and which is positioned on the downstream side with respect to the inclined surface in the feeding orientation.

17. The feeding apparatus according to claim 1, wherein the first projective portion is adjacent to the second projective portion, the second projective portion has a continuous surface which is continuous from a lower end of the contact portion and along the contact portion, and the first projective portion has a fourth extending portion extending toward the upstream side in the feeding orientation from a position below the contact portion and corresponding to the contact portion in the feeding orientation.

18. The feeding apparatus according to claim 1, wherein the first tray includes movement support portions at both ends in the width direction, respectively, configured to support the second tray to be movable relative to the first tray, and the supporting portion is provided between the movement support portions in the width direction.

19. The feeding apparatus according to claim 1, wherein the first projective portion is arranged at each of two positions different in the width direction, the feeding section has a supporting shaft, an arm retained by the supporting shaft to be revolvable about one end, and a feed roller retained by the other end of the arm to rotate and make contact with the sheets, and the feed roller is provided between the two positions at which the first projective portions are arranged respectively in the width direction.

20. The feeding apparatus according to claim 1, wherein the second projective portion extends upward longer than the first projective portion.

21. The feeding apparatus according to claim 1, wherein the guide surface is configured to separate the sheets which are fed by the feeding section from one of the first tray and the second tray.

22. The feeding apparatus according to claim 1, wherein a recess is formed in the guide surface, and in the state that the first tray is positioned at the first position, the first projective portion and the second projective portion are accommodated in the recess.

23. An image recording apparatus configured to record images on sheets, the apparatus comprising:

the feeding apparatus as defined in claim 1; and a recording section configured to record the images on the sheets fed by the feeding section.

24. A feeding apparatus configured to feed sheets, the apparatus comprising:

an apparatus main body;

a feeding section configured to feed the sheets in a feeding orientation;

a first tray configured to be changeable in its state relative to the apparatus main body between a first state in which the feeding section can feed the sheets and a second state in which the feeding section cannot feed the sheets, and comprising:

a first loading plate for loading some of the sheets;

first projective portions projecting upward from an end portion of the first loading plate on the downstream side in the feeding orientation at two different positions in a width direction perpendicular to the feeding orientation respectively, and provided with supporting portions on upper ends thereof respectively; and second projective portions projecting upward from the end portion of the first loading plate on the downstream side in the feeding orientation, positioned at two different positions outside of the first projective portions in the width direction, provided with contact portions respectively each having a surface which is positioned on the upstream side with respect to the supporting portions of the first projective portions in the feeding orientation at least from a position as high as one of the supporting portions to a position higher than the one of the supporting portions;

a second tray provided above the first tray, comprising: a second loading plate for loading the other of the sheets; third projective portions projecting upward from an end portion of the second loading plate on the downstream side in the feeding orientation at two different positions in the width direction; and supported portions configured to be supported by the supporting portions of the first projective portions respectively, and being changeable in its state relative to the first tray between a third state in which the supported portions are at the same positions as the supporting portions in the feeding orientation and a fourth state in which the supported portions are on the upstream side with respect to the supporting portions in the feeding orientation; and a guide provided in the apparatus main body and having an inclined surface, the inclined surface being inclined such that its upper end is positioned on the downstream side with respect to its lower end in the feeding orientation and guiding the sheets which are fed by the feeding section from one of the first tray and the second tray and which make contact with the inclined surface, wherein under a condition that the first tray is in the first state, the first projective portions and the second projective portions are positioned on the downstream side of the guide surface in the feeding orientation, under a condition hat the first is in the second state, the first projective portions and the second projective portions are positioned on the upstrear side of the guide surface in the feeding orientation, and an area of each of the second projective portions different from the contact portion on the upstream side in the feeding orientation, and areas of the first projective portions and the third projective portions on the upstream side in the feeding orientation are step-like such that upper ends thereof are on the downstream side with respect to the lower ends thereof in the feeding orientation respectively.

25. The feeding apparatus according to claim 24, wherein recesses are formed in the guide surface, and under the condition that the first tray is in the first state, the first projective portions and the second projective portions are accommodated in the recesses.

* * * * *